US009661982B2

(12) United States Patent
Dabade et al.

(10) Patent No.: US 9,661,982 B2
(45) Date of Patent: May 30, 2017

(54) EASIER LOADING AND UNLOADING SILVERWARE BASKETS FOR AUTOMATIC DISHWASHERS

(71) Applicant: Whirlpool Corporation, Benton Harbor, MI (US)

(72) Inventors: Sujay S. Dabade, Solapur (IN); Sujit S. Naik, Pune (IN); Hrushikesh C. Prabhu, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 33 days.

(21) Appl. No.: 14/657,115

(22) Filed: Mar. 13, 2015

(65) Prior Publication Data

US 2015/0305593 A1 Oct. 29, 2015

Related U.S. Application Data

(60) Provisional application No. 61/983,657, filed on Apr. 24, 2014.

(51) Int. Cl.
*A47L 15/50* (2006.01)

(52) U.S. Cl.
CPC ..... *A47L 15/502* (2013.01); *A47L 15/505* (2013.01)

(58) Field of Classification Search
CPC ..... A47L 15/502; A47L 15/505
USPC ..... 220/485, 486, 487, 488, 491, 494, 4.08, 220/4.28, 625
See application file for complete search history.

(56) References Cited

U.S. PATENT DOCUMENTS

| | | | | |
|---|---|---|---|---|
| 4,058,233 | A * | 11/1977 | Frangos | B65D 7/20 220/23.2 |
| D391,696 | S | 3/1998 | Bournay, Jr. et al. | |
| 5,881,906 | A * | 3/1999 | Rogers | A47L 15/502 220/488 |
| 6,415,934 | B1 * | 7/2002 | Veltrop | A47J 37/1295 211/85.4 |
| D488,891 | S | 4/2004 | Smith et al. | |
| D502,295 | S | 2/2005 | Feddema | |
| 7,594,513 | B2 | 9/2009 | VanderRoest et al. | |
| 7,694,844 | B2 | 4/2010 | Woo | |
| 7,861,883 | B2 | 1/2011 | Purushothaman | |
| 2002/0139809 | A1 * | 10/2002 | Barry | A47L 15/502 220/762 |
| 2004/0094555 | A1 * | 5/2004 | Raches | A47L 15/502 220/476 |
| 2007/0039971 | A1 * | 2/2007 | Purushothaman | A47L 15/502 220/676 |
| 2008/0128371 | A1 | 6/2008 | Oppel et al. | |
| 2012/0118337 | A1 | 5/2012 | Ayvazoglu et al. | |

(Continued)

*Primary Examiner* — Robert J Hicks
*Assistant Examiner* — Kareen Thomas

(57) ABSTRACT

Easier loading and unloading silverware baskets for automatic dishwashers are disclosed. A disclosed example silverware basket includes four side walls defining a basket having a top opening and a bottom opening, a moveable first member dimensioned to fit within the top opening and selectively moveable between a first position near the top opening and a second position between the top opening and the bottom opening, and a moveable second member dimensioned to fit within the bottom opening and selectively moveable between a third position near the bottom opening and a fourth position between the top opening and the bottom opening.

18 Claims, 22 Drawing Sheets

(56) References Cited

U.S. PATENT DOCUMENTS

| | | | | |
|---|---|---|---|---|
| 2013/0270982 | A1 | 10/2013 | Garnett et al. | |
| 2013/0328465 | A1* | 12/2013 | Shewmaker | A47L 15/502 312/228.1 |

* cited by examiner

EASIER LOADING AND UNLOADING SILVERWARE BASKETS FOR AUTOMATIC DISHWASHERS

RELATED APPLICATION(S)

This application claims the priority benefit of U.S. Provisional Application No. 61/983,657, filed on Apr. 24, 2014, and entitled "Easier Loading and Unloading Silverware Baskets for Automatic Dishwashers," the entirety of which is incorporated herein by reference.

FIELD OF THE DISCLOSURE

This disclosure relates generally to automatic dishwashers, and, more particularly, to easier loading and unloading silverware baskets for automatic dishwashers.

BACKGROUND

Silverware baskets are used in automatic dishwashers to hold silverware to facilitate cleaning of the silverware.

SUMMARY

Easier loading and unloading silverware baskets for automatic dishwashers are disclosed. A disclosed example silverware basket includes four side walls defining a basket having a top opening and a bottom opening, a moveable first member dimensioned to fit within the top opening and selectively moveable between a first position near the top opening and a second position between the top opening and the bottom opening, and a moveable second member dimensioned to fit within the bottom opening and selectively moveable between a third position near the bottom opening and a fourth position between the top opening and the bottom opening.

Another disclosed example silverware basket for use in a dishwasher includes four side walls defining a basket having an opening, and a moveable member dimensioned to fit within the opening and selectively moveable between a first position near the opening and a second position separated apart from the opening.

A disclosed example method of using a silverware basket includes moving a top member of the basket to a position lower than the top of the basket, placing silverware in the basket, and moving the top member to generally a position at the top of the basket.

DETAILED DESCRIPTION

Figure 1:
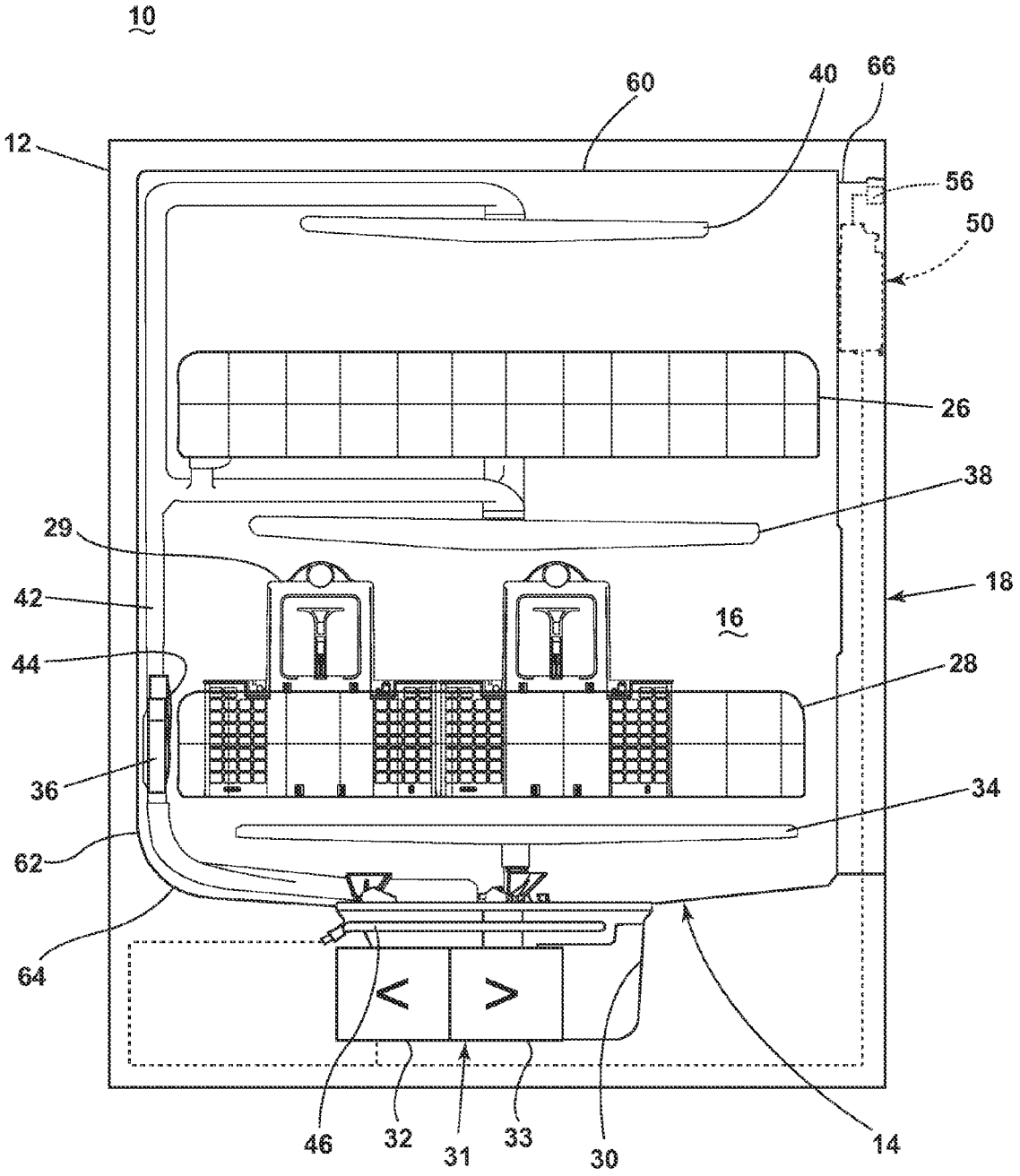
FIG. 1 is a schematic, cross-sectional view of an example dishwasher including a silverware basket constructed in accordance with the teachings of this disclosure.

The configurations of some conventional silverware baskets encourage and/or necessitate piece-by-piece loading and unloading of silverware. Additionally, some conventional silverware baskets result in inadvertent touching of the clean feeding areas of silverware as silverware is unloaded. To overcome at least these deficiencies, example silverware baskets are disclosed that, at least, enable the bulk loading of silverware, reduce the need to manually separate silverware during loading, increase mechanical separation of silverware prior to treatment, and lift the silverware partially upward out of the silverware basket to enable a user to grasp the silverware by its stem thereby reducing inadvertent touching of clean feeding areas.

While in this disclosure references are made to silverware baskets and silverware, it will be recognized that any number and/or type(s) of silverware, utensils, objects and/or items may be placed and treated in a silverware basket. Therefore, the meaning of the term "silverware basket" used herein is not restricted by the type(s) of items that are, may and/or could be placed in the silverware basket. Moreover, while silverware baskets may be referred to by other substantially equivalent names such as a utensil basket, for ease of discussion they will be referred to herein as silverware baskets. Furthermore, the use of a silverware basket is not restricted to use during a cleaning cycle of operation but may be used, for example, during any other treatment cycle such as, but not limited to, a rinse cycle, a dry cycle, etc.

In general, identical elements are illustrated with identical reference numerals in the figures, however, for brevity the description of identically numbered elements is not repeated. In some instances identical reference numerals are omitted when their inclusion could reduce clarity and/or comprehension.

FIG. 1 is a schematic view of example automated dishwasher 10 having a silverware basket constructed in accordance with the teachings of this disclosure. The example dishwasher 10 of FIG. 1 shares many features of a conventional automated dishwasher. A chassis 12 may define an interior of the dishwasher 10 and may include a frame, with or without panels mounted to the frame. An open-faced tub 14 may be provided within the chassis 12 and may at least partially define a treating chamber 16, having an open face, for washing dishes. A door assembly 18 may be movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders may be provided, such as easier loading and unloading silverware baskets, one of which is designated at reference numeral 29. The example silverware basket 29 will be discussed below in connection with FIGS. 3-23. As used in this description, the term "dish(es)" is intended to be generic to any item, single or plural, that may be treated in the dishwasher 10, including, without limitation, dishes, plates, pots, bowls, pans, glassware, silverware, and utensils.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 24 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system may include a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

Figure 2:
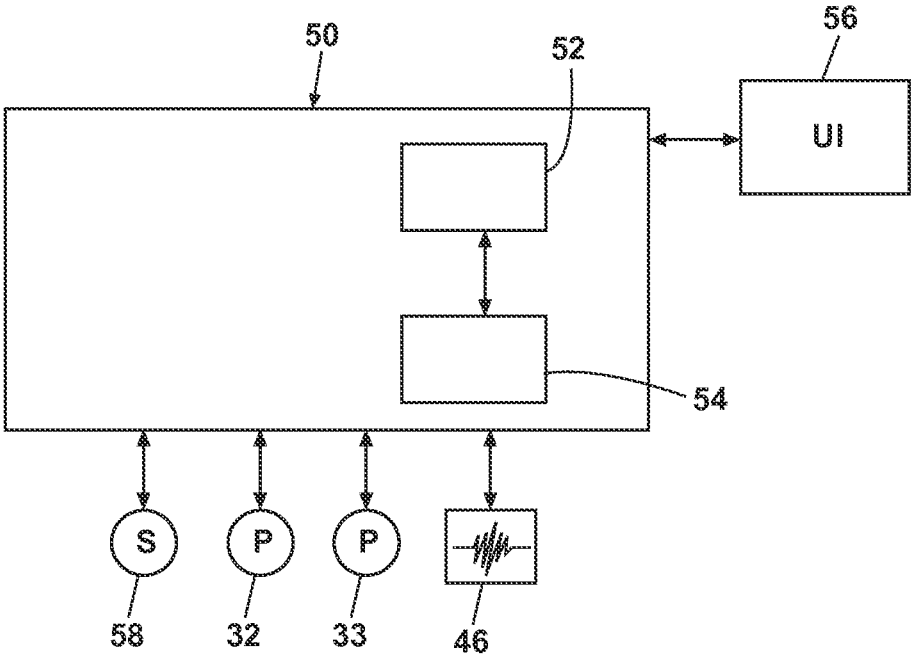
FIG. 2 is a schematic view of the example controller of FIG. 1.

As illustrated schematically in FIG. 2, the controller 50 may be coupled with the heater 46 for heating the wash liquid during a cycle of operation, the drain pump 32 for draining liquid from the treating chamber 16, and the recirculation pump 33 for recirculating the wash liquid during the cycle of operation. The controller 50 may be provided with a memory 52 and a central processing unit (CPU) 54. The memory 52 may be used for storing control machine-readable instructions that may be executed by the CPU 54 in completing a cycle of operation using the dishwasher 10 and any additional machine-readable instructions. For example, the memory 52 may store one or more pre-programmed cycles of operation that may be selected by a user and completed by the dishwasher 10. The controller 50 may also receive input from one or more sensors 58. Non-limiting examples of sensors that may be communicably coupled with the controller 50 include a temperature sensor and turbidity sensor to determine the soil load associated with a selected grouping of dishes, such as the dishes associated with a particular area of the treating chamber.

Figure 3:
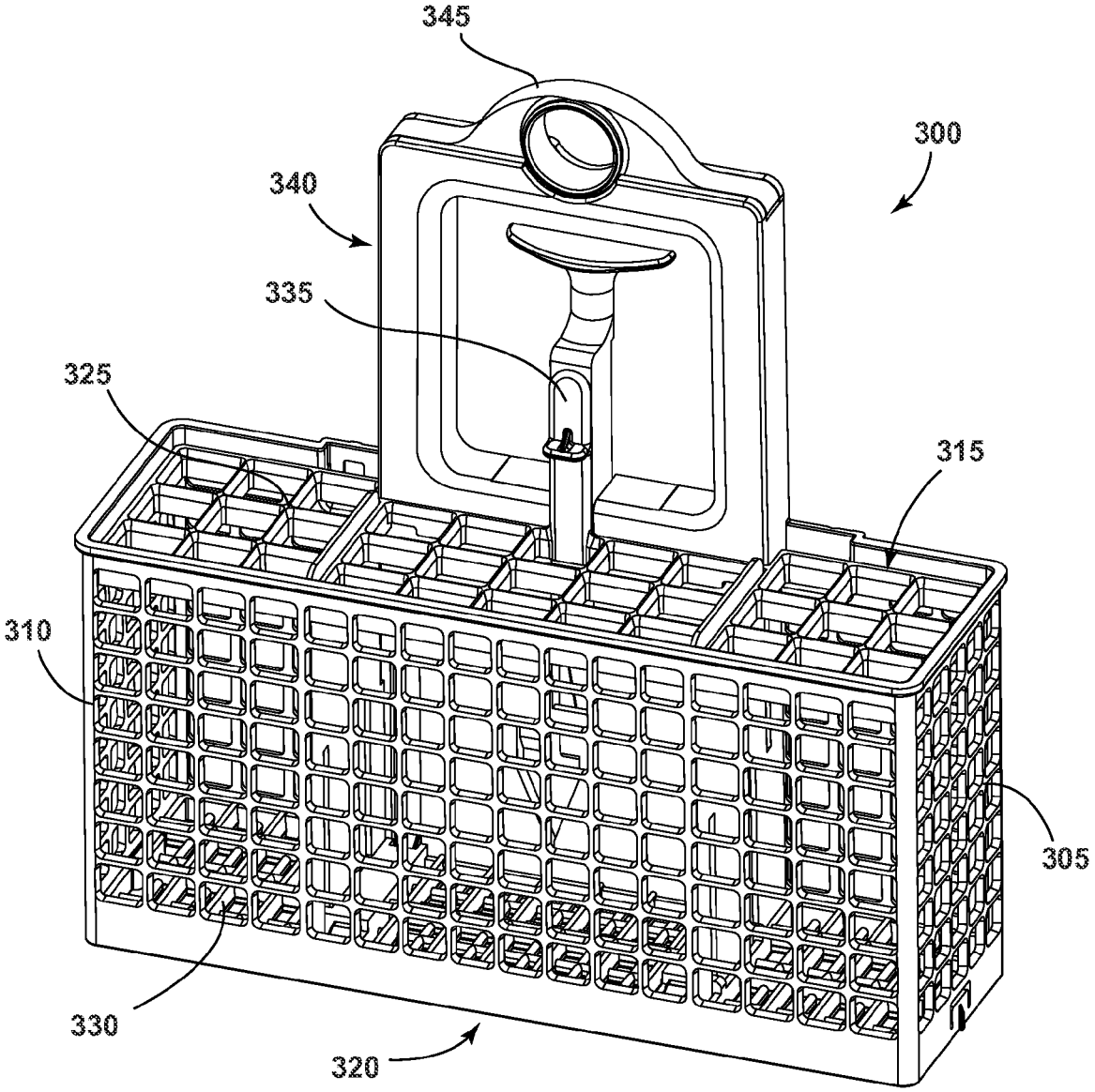
FIGS. 3 and 4 are isometric perspective views of example silverware baskets constructed in accordance with the teachings of this disclosure.

FIG. 3 is an isometric perspective view of an example silverware basket 300 constructed in accordance with this disclosure. The example silverware basket 300 includes four side walls, one of which is designated at reference numeral 305, that define a basket 310 having a top opening 315 and a bottom opening 320.

Figure 17:
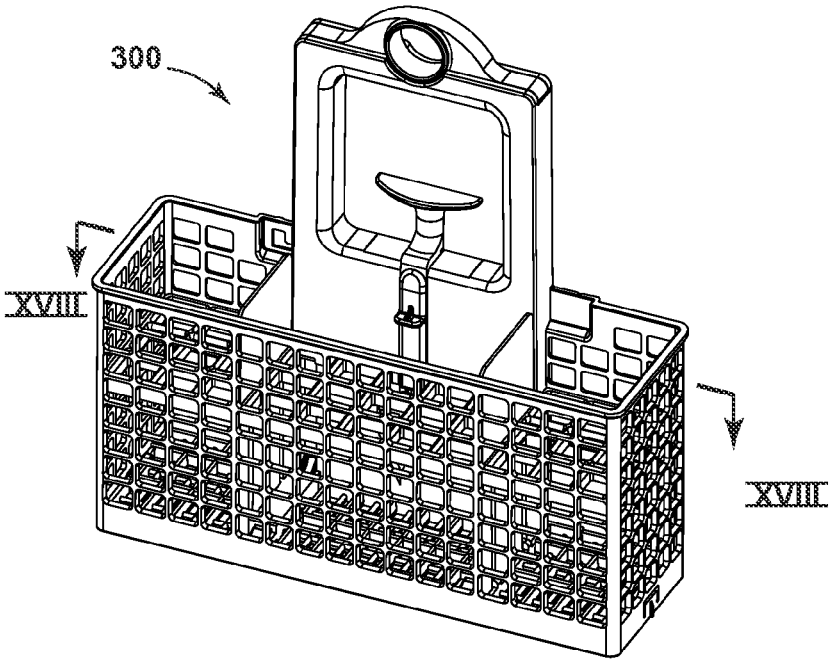
FIGS. 17 and 18 illustrate the example silverware basket of FIG. 3 in a state that facilitates easy loading of silverware.
Figure 18:
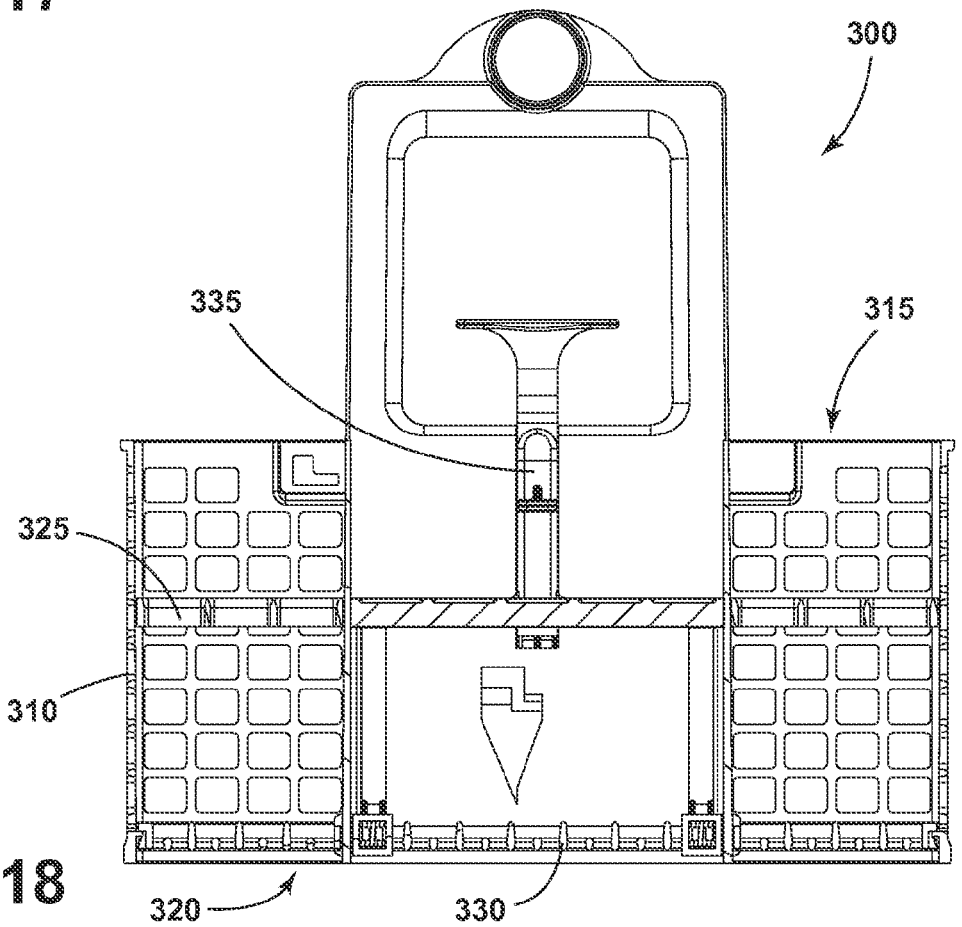

The silverware basket 300 includes a moveable top member 325 that is dimensioned to fit in the top opening 315 and is selectively moveable up and down between a first position near the top opening 315 (as shown in FIG. 3), and a second position within the silverware basket 300 (as shown in at least FIGS. 17 and 18). In some examples, the top member 325 moves parallel to the top opening 315, however, other movements are contemplated.

The example top member 325 of FIG. 3 includes an element 335 that can be grasped or otherwise used to selectively move and/or position the top member 325 up and down within the basket 310.

Figure 21:
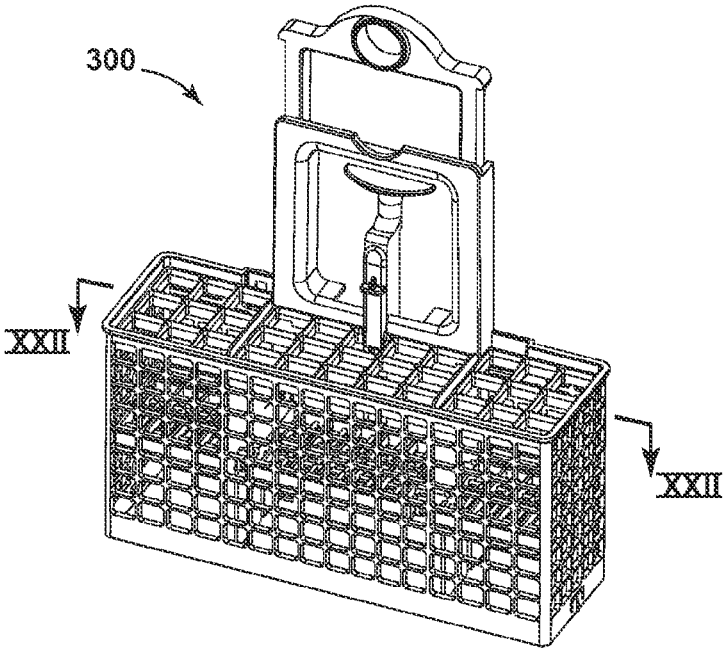
FIGS. 21 and 22 illustrate the example silverware basket of FIG. 3 in a state that facilitates easy unloading of silverware.
Figure 22:
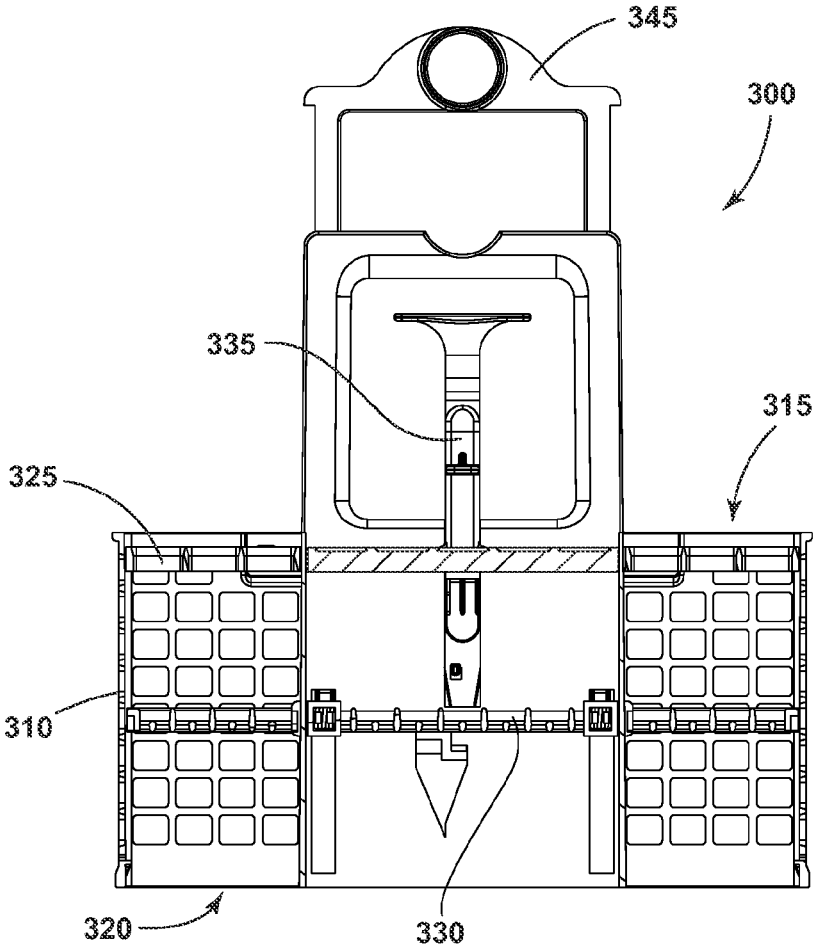

The example silverware basket 300 of FIG. 3 also includes a moveable bottom member 330 that is dimensioned to fit in the bottom opening 320 and is selectively moveable up and down between a first position near the bottom opening 320 (as shown in FIG. 3), and a second position within the silverware basket 300 (as shown in at least FIGS. 21 and 22). In some examples, the bottom member 330 moves parallel to the bottom opening 325, however, other movements are contemplated.

While the example moveable members 325 and 330 are included in the examples depicted and discussed herein, it will be appreciated that other easier loading and unloading silverware baskets constructed in accordance with this disclosure may include other number and/or type(s) of moveable members.

The example silverware basket 300 includes a handle assembly 340 configured for lifting and/or carrying the silverware basket 300. The example handle assembly of FIG. 3 includes a moveable handle 345. The example moveable handle 345 of FIG. 3 is configured to selectively move the bottom member 330 up and down within the basket 310.

Figure 4:
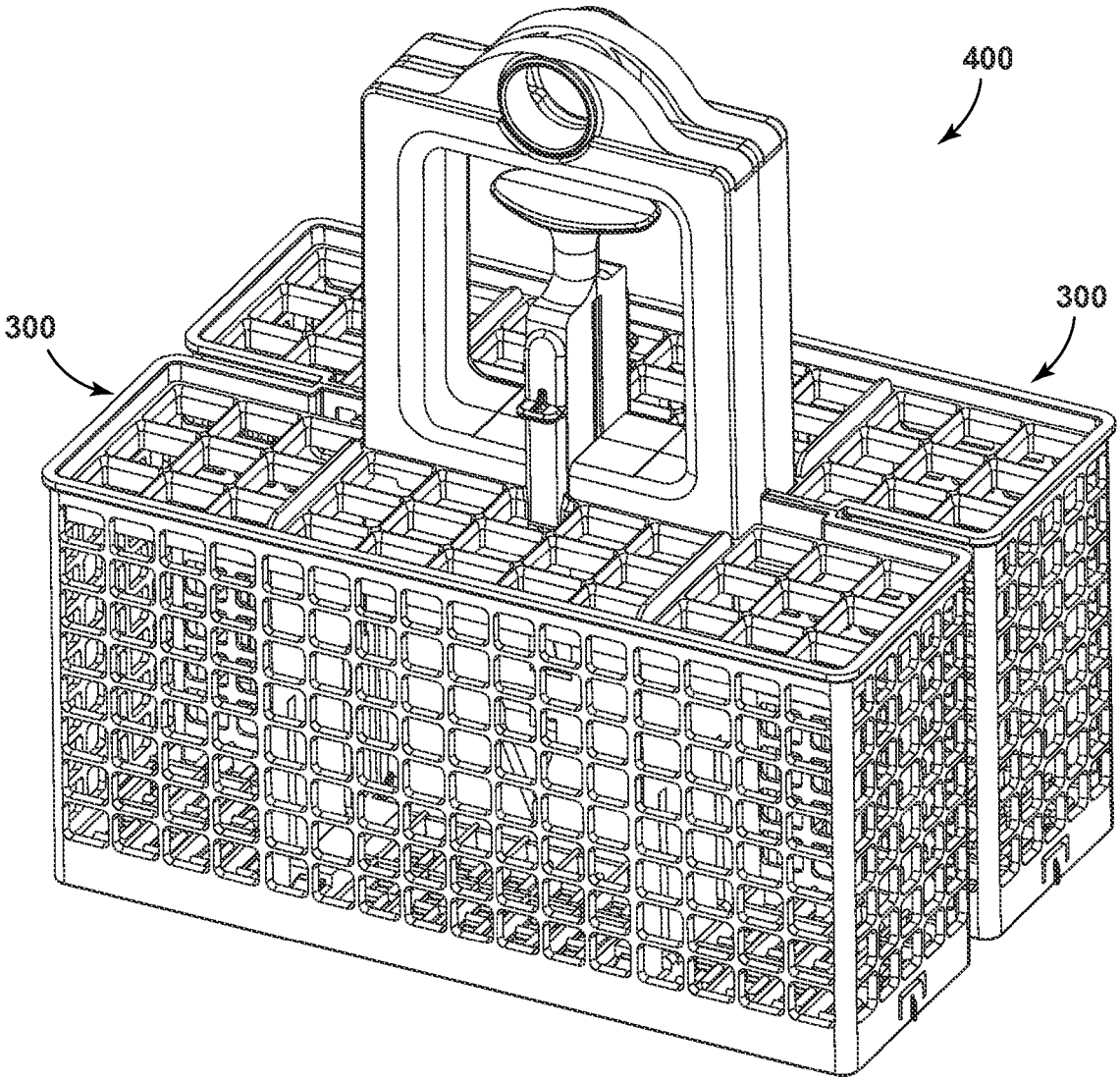

Turning to the isometric perspective view of FIG. 4, an example silverware basket 400 having two instances of the example silverware basket 300 of FIG. 3 is shown. Because the silverware baskets 300 of the example silverware basket 400 of FIG. 4 are identical to that discussed above in connection with FIG. 3, the description of the silverware baskets 400 is not repeated here. Instead, the interested reader is referred back to the descriptions presented above in connection with FIG. 3. While an example arrangement of the silverware baskets 300 is shown in FIG. 4, it will be appreciated that other silverware baskets having different numbers and/or arrangements of the silverware basket 300 and/or equivalents thereof are contemplated.

FIGS. 5-10 illustrate example components that may be used to construct the example silverware basket 300 of FIG. 3. While it will be understood that the example components of FIGS. 5-10 may also be used to construct the example silverware basket 400 of FIG. 4, for ease of discussion the components of FIGS. 5-10 will be described in the context of FIG. 3. Moreover, while examples manners of constructing the example silverware baskets 300 and 400 of FIGS. 3 and 4 are depicted in FIGS. 5-23, one or more of the depicted elements and/or members may be combined, divided, rearranged, omitted, eliminated and/or implemented in any other way. Further still, the example silverware baskets 300 and 400 may include elements and/or members instead of, or in addition to, those illustrated in FIGS. 5-23, and/or may include more than one of any or all of the illustrated elements and/or members.

Figure 5A:
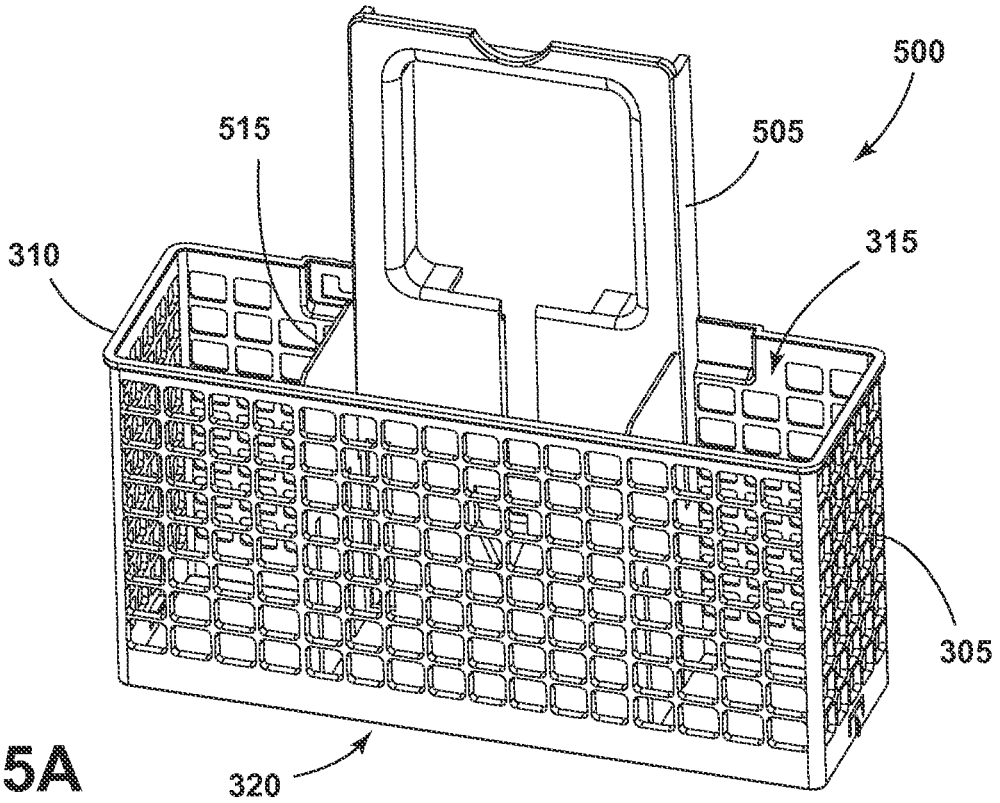
FIGS. 5A-B, 6, 7, 8A-B, 9 and 10A-B are isometric perspective views illustrating example components of the example silverware basket of FIG. 3.
Figure 5B:
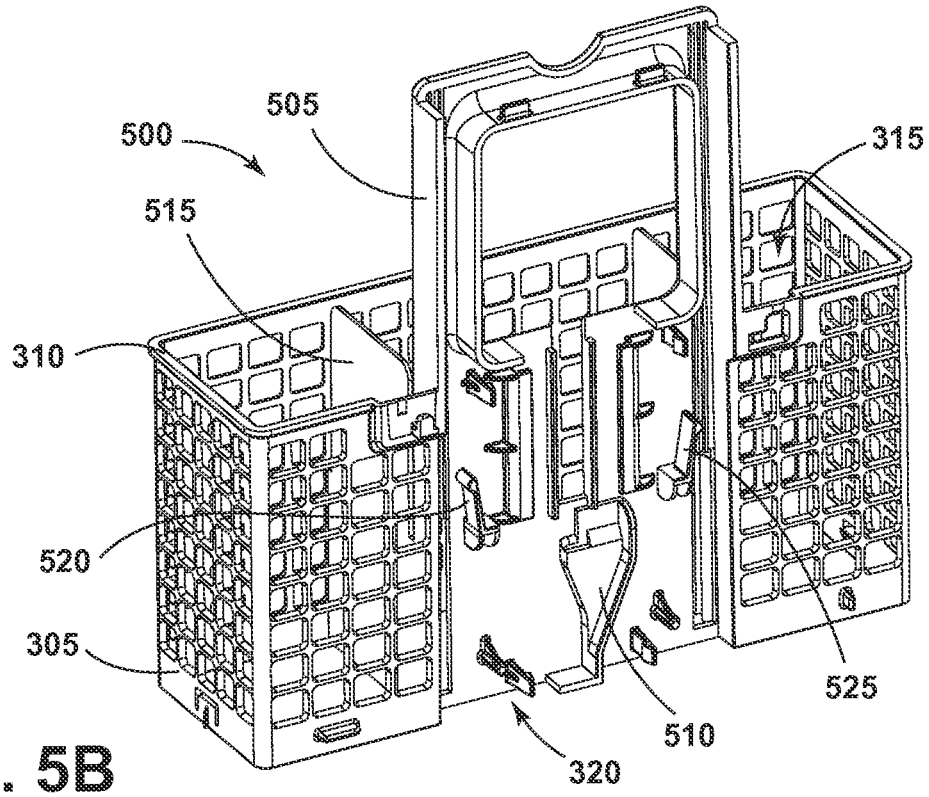

FIGS. 5A and 5B are isometric front and rear perspective views of an example basket body 500 that includes the example basket 310. The example basket body 500 of FIGS. 5A and 5B includes a handle 505. The example handle 505 is configured for lifting and/or carrying the silverware basket 300. While not fully enumerated in FIGS. 5A and 5B, the handle 505 has numerous defined features (one of which is illustrated at reference numeral 510 in FIG. 5B) that facilitate the assembly and operation of the example silverware basket 300. In some examples, the basket 310 includes one or more dividers, one of which is designated at reference numeral 515. To engage the moveable handle 345, the example handle 505 includes flexible members 520 and 525 (see at least FIG. 15).

Figure 6:
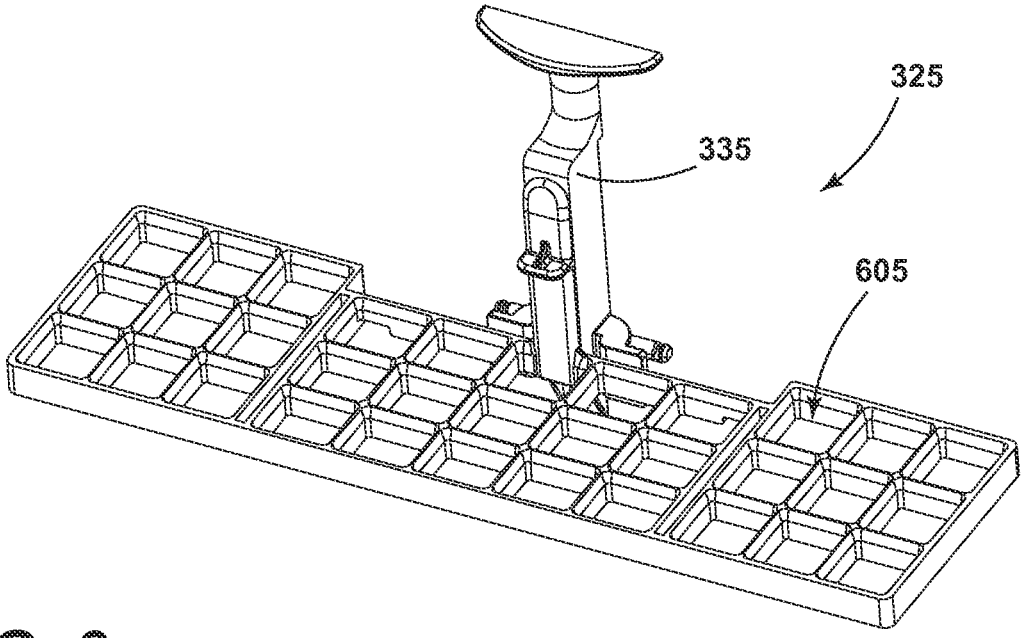

FIG. 6 is a top isometric perspective view of an example manner of implementing the example top member 325 of FIG. 3. The example top member 325 of FIG. 6 includes the element 335 that is configured to be grasped and/or otherwise used to selectively move and/or position the top member 325 up and down within the basket 310. The example top member 325 is dimensioned to fit in the top opening 315 and is selectively moveable (e.g., using the element 335) up and down between a first position near the top opening 315 (as shown in FIG. 3), and a second position within the silverware basket 300 (as shown in at least FIGS. 17 and 18). As shown in FIG. 6, the top member 325 includes slots and/or openings (one of which is designated at reference numeral 605) defined therein and dimensioned to receive stems of silverware and/or utensils placed in the silverware basket 300 for treatment. Dimensions of the slots and/or openings 605 are design choices that may, for example, vary over time and/or be according to the dimensions of silverware in different geographical regions.

Figure 7:
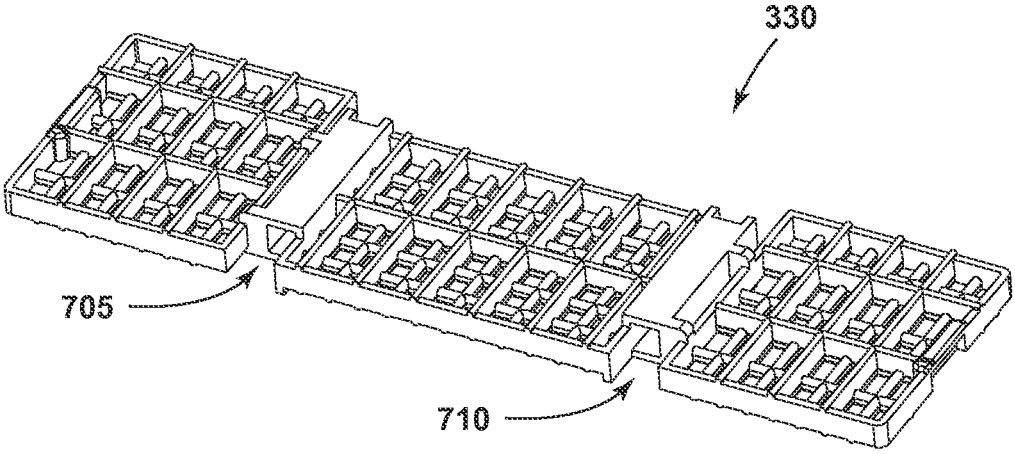

FIG. 7 is a top isometric perspective view of an example manner of implementing the example bottom member 330 of FIG. 3. The example bottom member 330 of FIG. 7 includes slots 705 and 710 dimensioned to receive extending members 910 and 915 of the example moveable handle 345 (see FIGS. 9 and 14) that is configured to move the bottom member 330 up and down within the basket 310. The example bottom member 330 is dimensioned to fit in the bottom opening 320 and is selectively moveable between a first position near the bottom opening 320 (as shown in FIG. 3), and a second position within the silverware basket 300 (as shown in at least FIGS. 21 and 22). In some examples, slots and/or openings defined in the bottom member 330 are provided to drain liquid but are dimensioned to prevent silverware and/or utensils placed in the silverware basket 300 from partially or wholly passing through the bottom member 330.

Figure 8A:
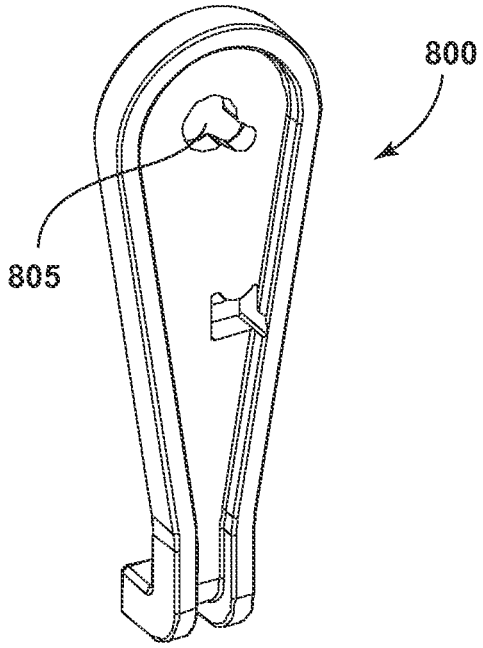
Figure 8B:
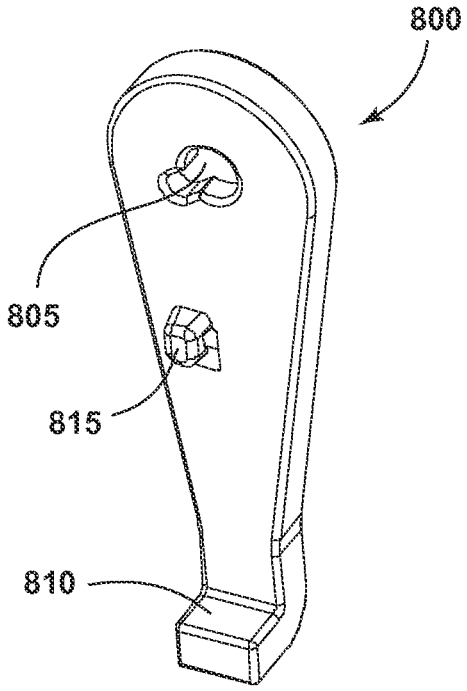

FIGS. 8A and 8B are front and back isometric perspective views of an example lever 800 that maintains and/or otherwise allows the position of the top member 325 within the basket 310 to be locked and/or fixed. Interactions of the example lever 800 of FIGS. 8A-B and the element 335 of the top member 325 will be described below in detail in connection with FIGS. 23A-H. As shown in at least FIGS. 8, 12 and 14, the lever 800 includes a hole 805 dimensioned to engage a protrusion 1205 of the example element 335. To guide the movement and/or operation of the lever 800, the lever 800 includes a first protrusion 810. As shown in FIGS. 23A-H, the example protrusion 810 moves along the feature 510 defined on the handle 505. To allow a biasing spring 1210 (see FIG. 12) to be attached to the lever 800, the lever 800 includes a hook-shaped second protrusion 815. When the spring 1210 is attached to the protrusion 815 and to a post 1215 defined on the element 335 (see FIG. 12), the spring 1210 biases the lever 800 toward the right (in the orientation of FIG. 12) against one or more edges of the feature 510 (see FIGS. 23A-H). The spring 1210 also biases the lever 800 against the backside of the handle 505. That is, against a plane perpendicular to FIGS. 23A-H. This biasing force allows the lever 800 to positively engage a notch 2315 defined in the feature 510 (see FIG. 23E). Thus, retaining and/or holding the lever 800 in an upward position and thereby retaining and/or holding the top member 325 at a position near the top opening 315 (see FIGS. 19 and 20).

Figure 9:
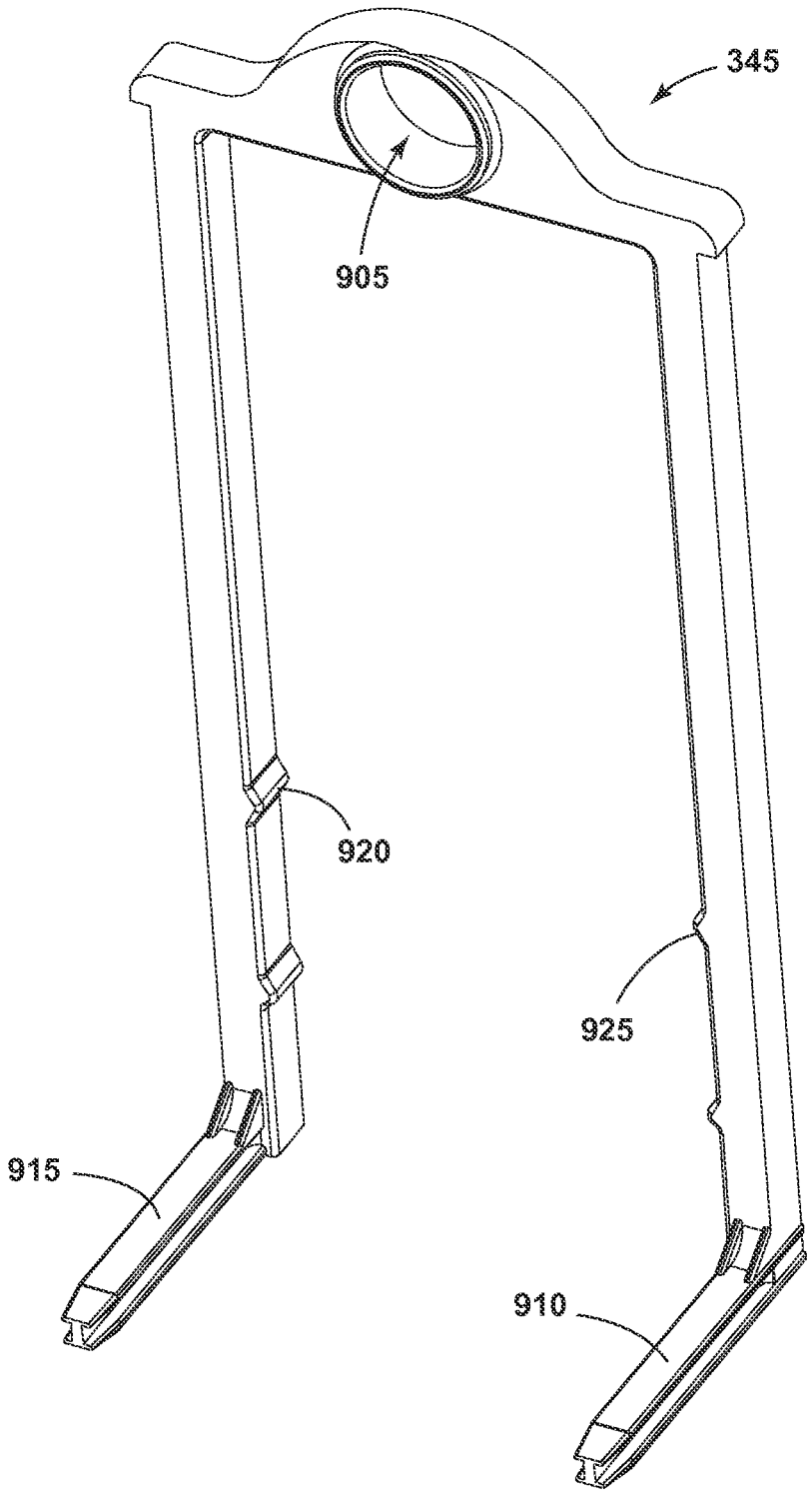

FIG. 9 is a front isometric perspective view of an example manner of implementing the example moveable handle 345 of FIG. 3. In the example of FIG. 9, the moveable handle 345 includes an opening 905 defined therethrough that allows a user to move the moveable handle 345 up and down. While an opening 905 is shown in FIG. 9, it will be understood that other features may be defined on and/or through the moveable handle 345 to facilitate movement of the moveable handle 345.

To engage the bottom member 330, the example moveable handle 345 includes the example extending members 910 and 915. The extending members 910 and 915 engage the slots 705 and 710 of the bottom member 330 (see FIG. 14). As the moveable handle 345 is moved up and down, the extending member 910 and 915 cause the bottom member 330 to move up and down.

Figure 15:
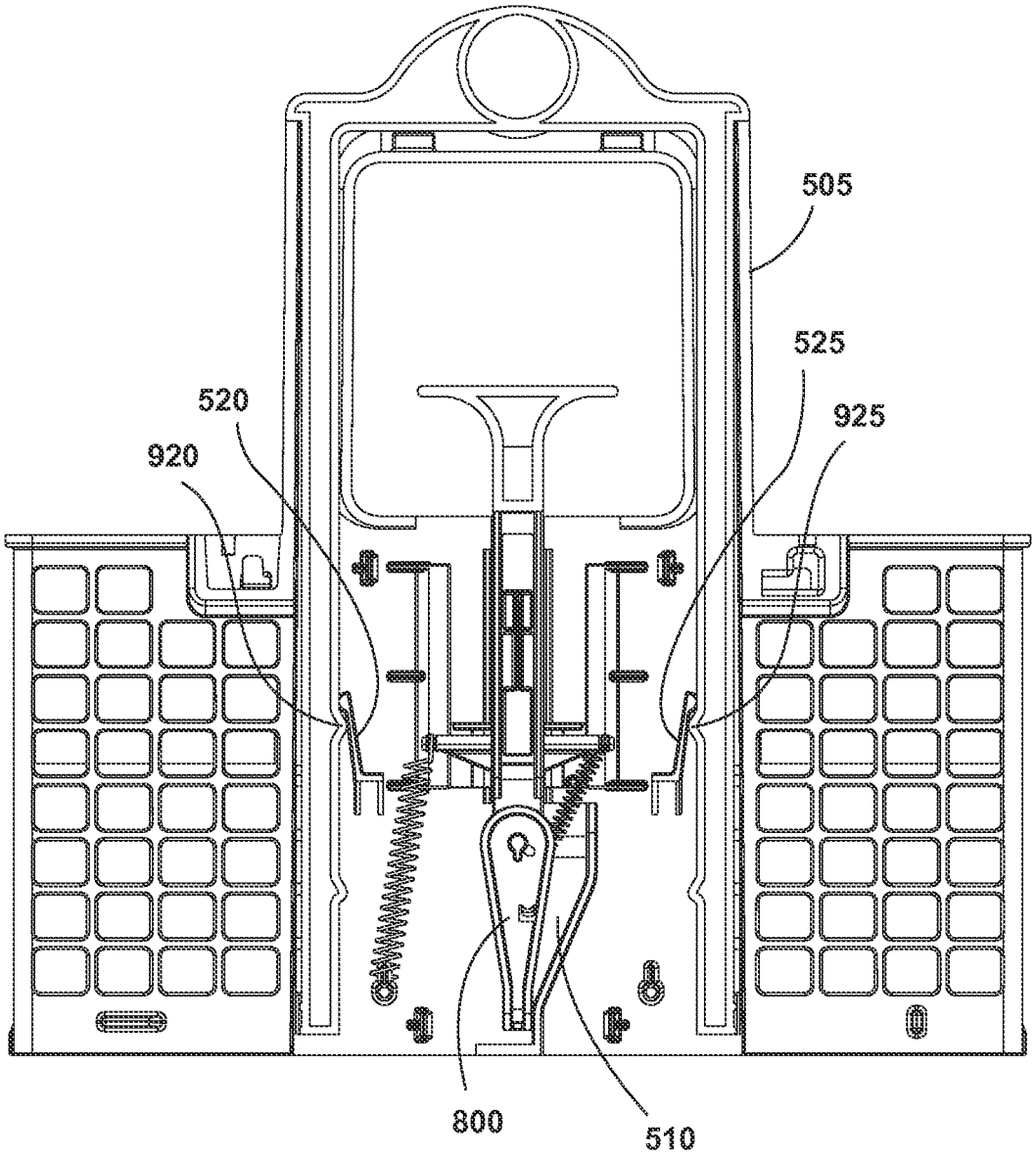

As shown in at least FIGS. 9 and 15, the moveable handle 345 includes protrusions, two or which are designated at reference numerals 920 and 925 that selectively engage the flexible members 520 and 525 of the handle 505. The protrusions 920 and 925 and the flexible members 520 and 525 are configured to engage to selectively retain the bottom member 330 in an upward position (see FIGS. 21 and 22).

Figure 10A:
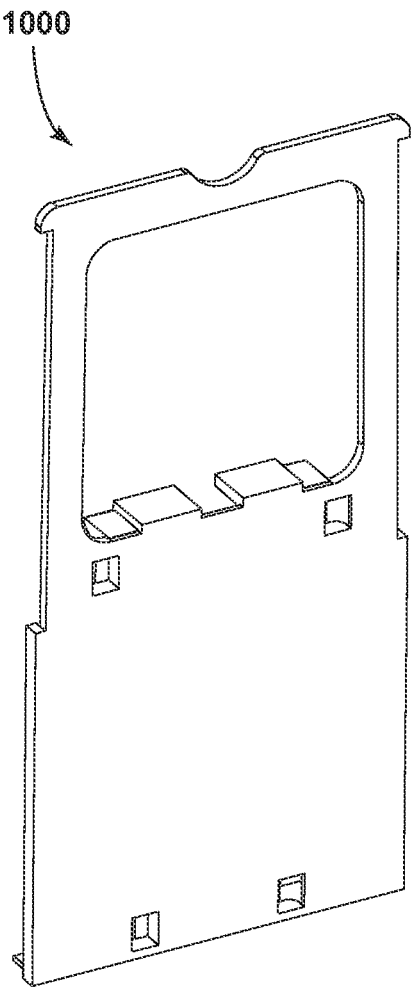
Figure 10B:
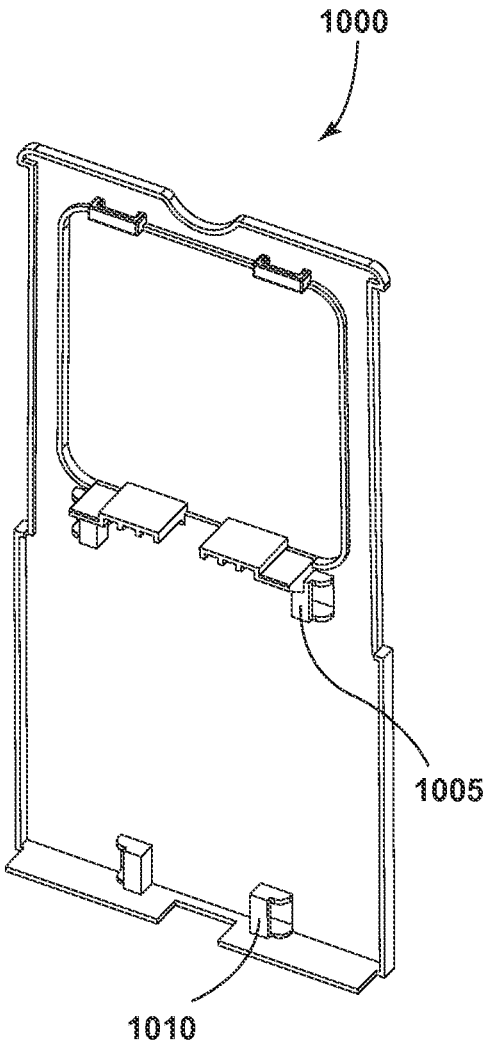

FIGS. 10A and B are front and rear isometric perspective views of an example back 1000 for the example handle assembly 340 of FIG. 1. The example back 1000 includes one or more features, two of which are designated at reference numerals 1005 and 1010 that engage features defined in the handle 505 (two of which are designated at reference numerals 1605 and 1610 in FIG. 16) that enable the back 1000 to be attached and/or snapped to the handle 505. The example back 1000 retains the moveable handle 345 and the lever 800 within the handle assembly 340, and/or reduces the amount of liquids and/or food particles that can get into the handle assembly 340.

FIGS. 11-16 illustrate an example assembly sequence for the example silverware basket 300 of FIG. 3.

Figure 11A:
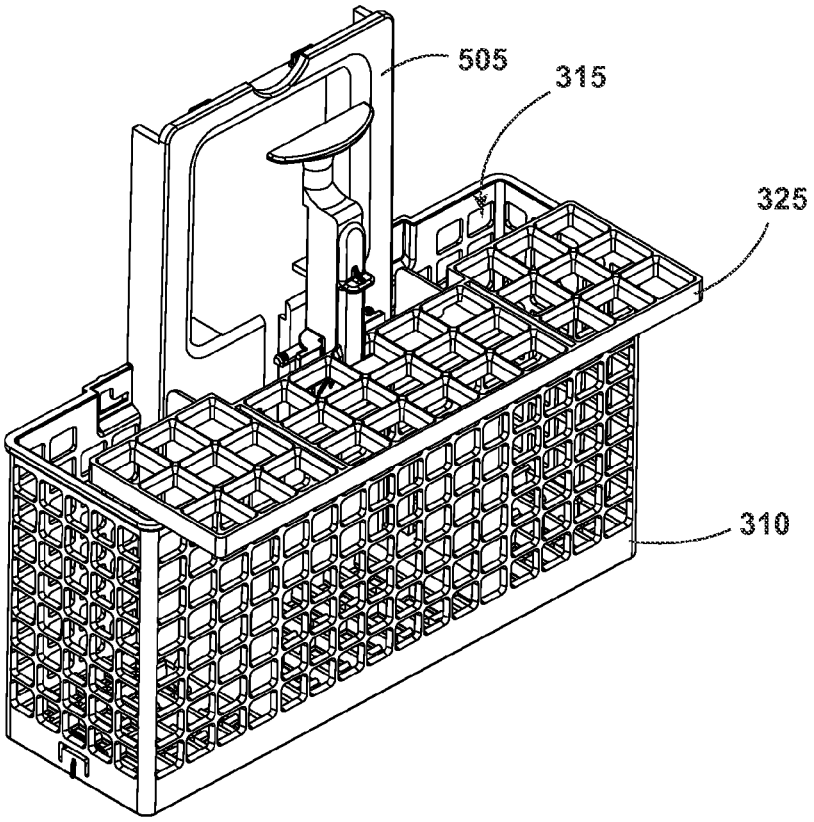
FIGS. 11A-B and 12-16 illustrate an example assembly of the example silverware basket of FIG. 3.
Figure 11B:
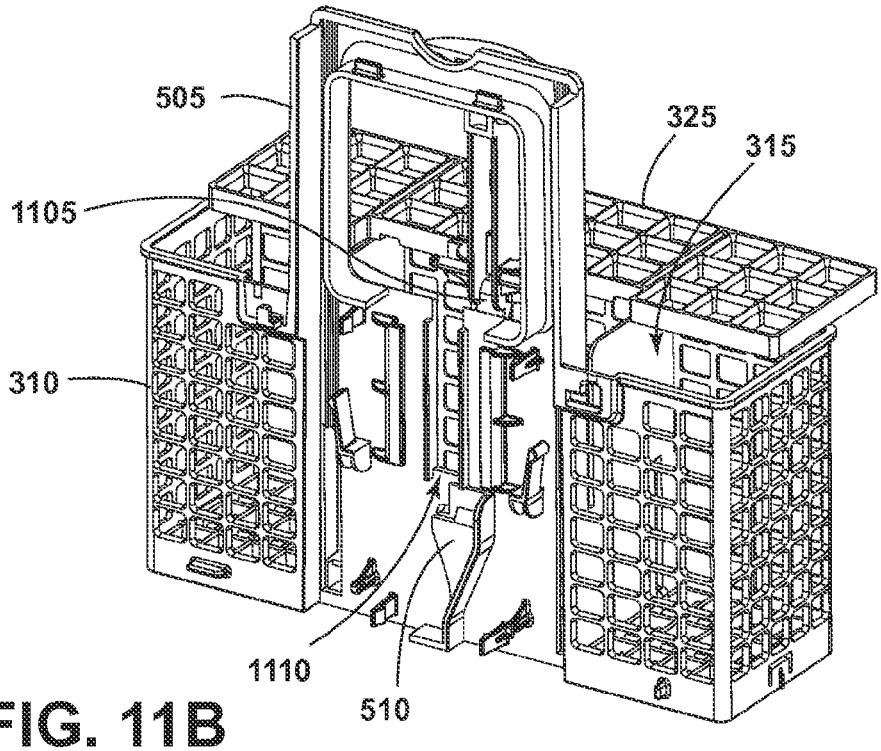

As shown in the front and rear isometric perspective views of FIGS. 11A and 11B, the moveable top member 325 is inserted into the top opening 315 of the basket 310. As shown in at least FIGS. 11A-B and 14, as the top member 325 is inserted into the top opening 315, a portion 1105 of the element 335 passes through and engages a slot 1110 defined in the handle 505.

Figure 12:
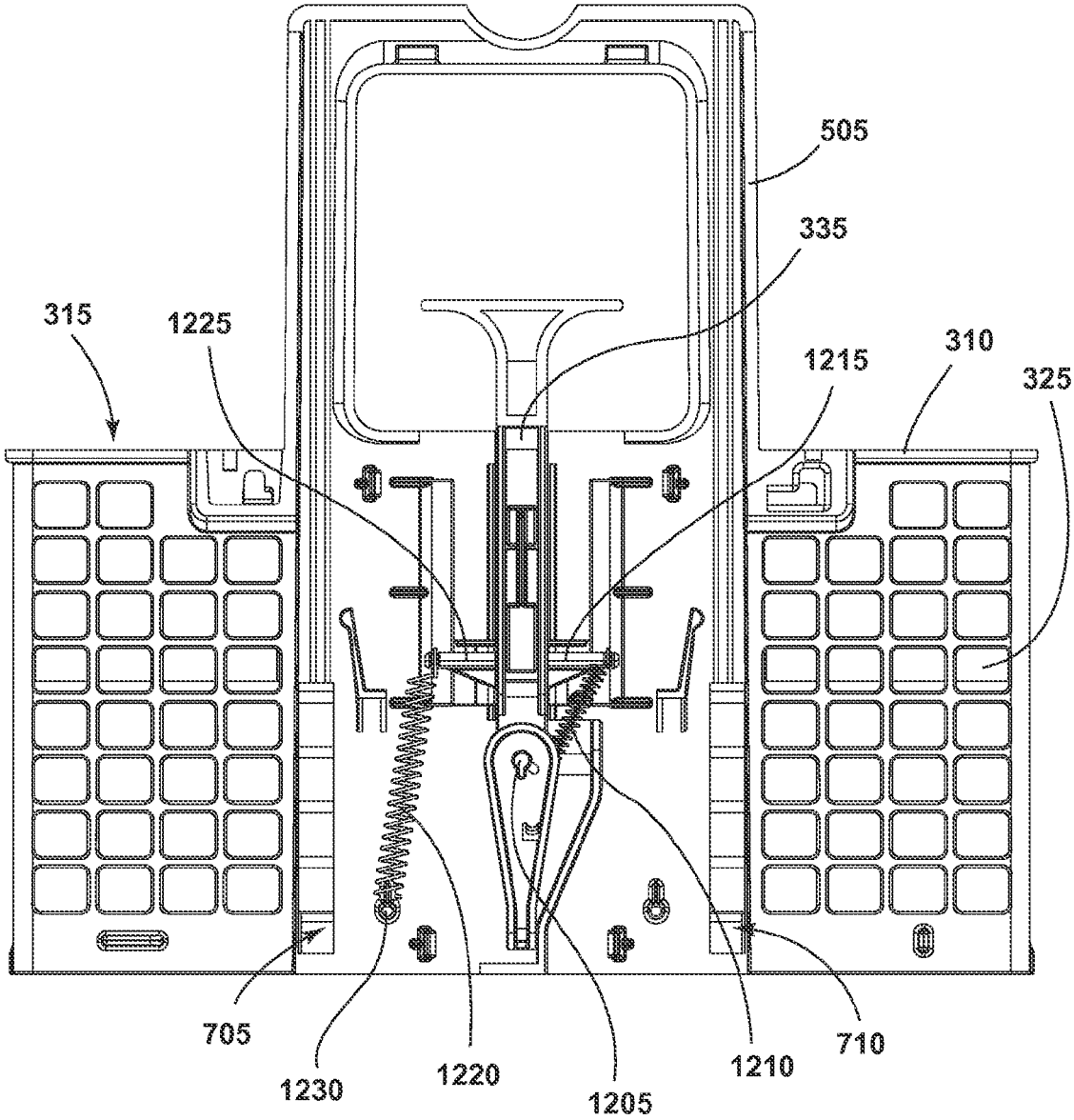

As shown in the rear view of FIG. 12, the hole 805 of the lever 800 is placed onto the protrusion 1205 of the portion 1105. The biasing spring 1210 is attached between the protrusion 815 of the lever 800 and the protrusion 1215 of the portion 1105. A second spring 1220 is affixed between a second protrusion 1225 of the portion 1105 and a protrusion 1230 defined on the handle 505. The second spring 1220 applies a downward force (in the orientation of FIG. 12) to the top member 325 to bias the top member 325 toward the shown silverware loading position.

Figure 13:
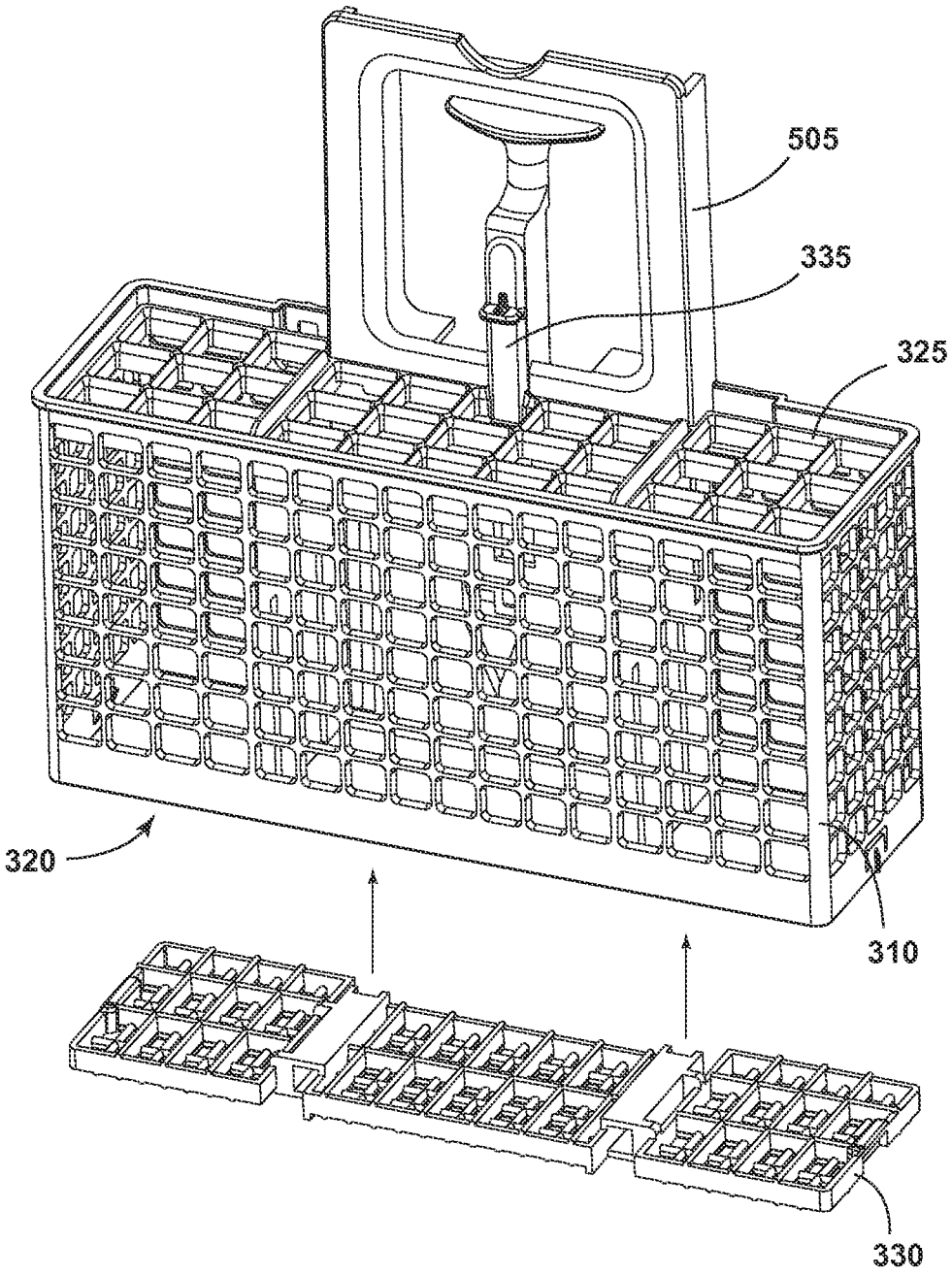

As shown in the isometric front view of FIG. 13, the moveable bottom member 330 is inserted into the bottom opening 320 of the basket 310.

Figure 14:
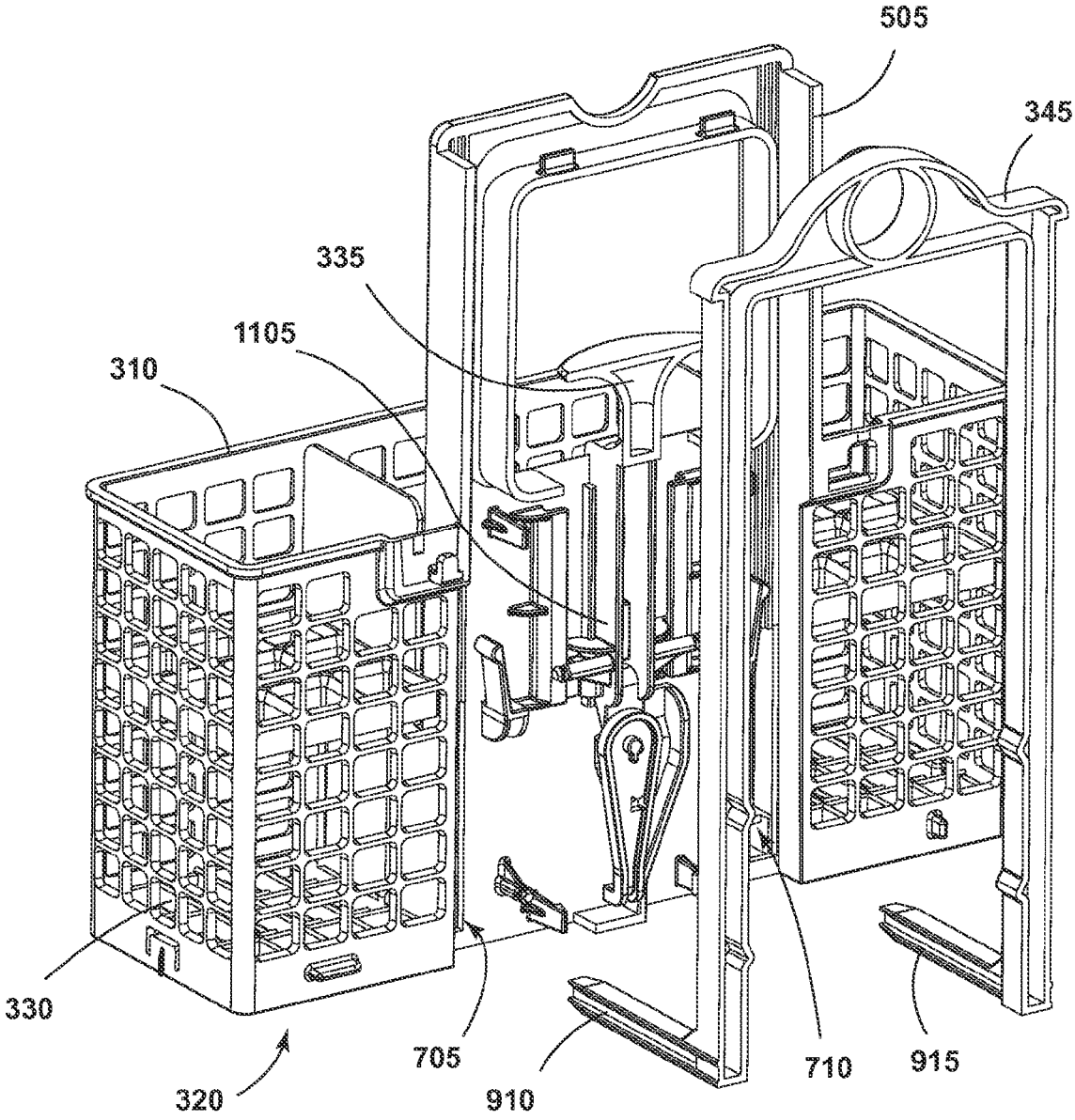

Turning to the rear isometric perspective view of FIG. 14, after the moveable bottom member 330 is inserted into the bottom opening 320, the moveable handle 345 is placed, inserted and/or fitted into the handle 505 thereby engaging the extending members 910 and 915 with the slots 705 and 710 defined in the bottom member 330.

As shown in the rear view of FIG. 15, when the moveable handle 345 is placed in the body 505, the protrusions 920 and 925 engage the flexible members 520 and 525. When the moveable handle 345 is in the lowered position of FIG. 15, lower protrusions 920 and 925 are located below the flexible members 520 and 525, thus, retaining the lower member 330 in its lowered position near the bottom opening 320. As the moveable handle element 340 is moved upward, lower protrusions 920 and 925 engage and move above the flexible members 520 and 525, thus, retaining the lower member 330 in its upper position (see FIGS. 21 and 22), enabling a person to easily unload silverware from the silverware basket 300 in bulk and/or piece-by-piece without having to hold onto the moveable handle 345.

Figure 16:
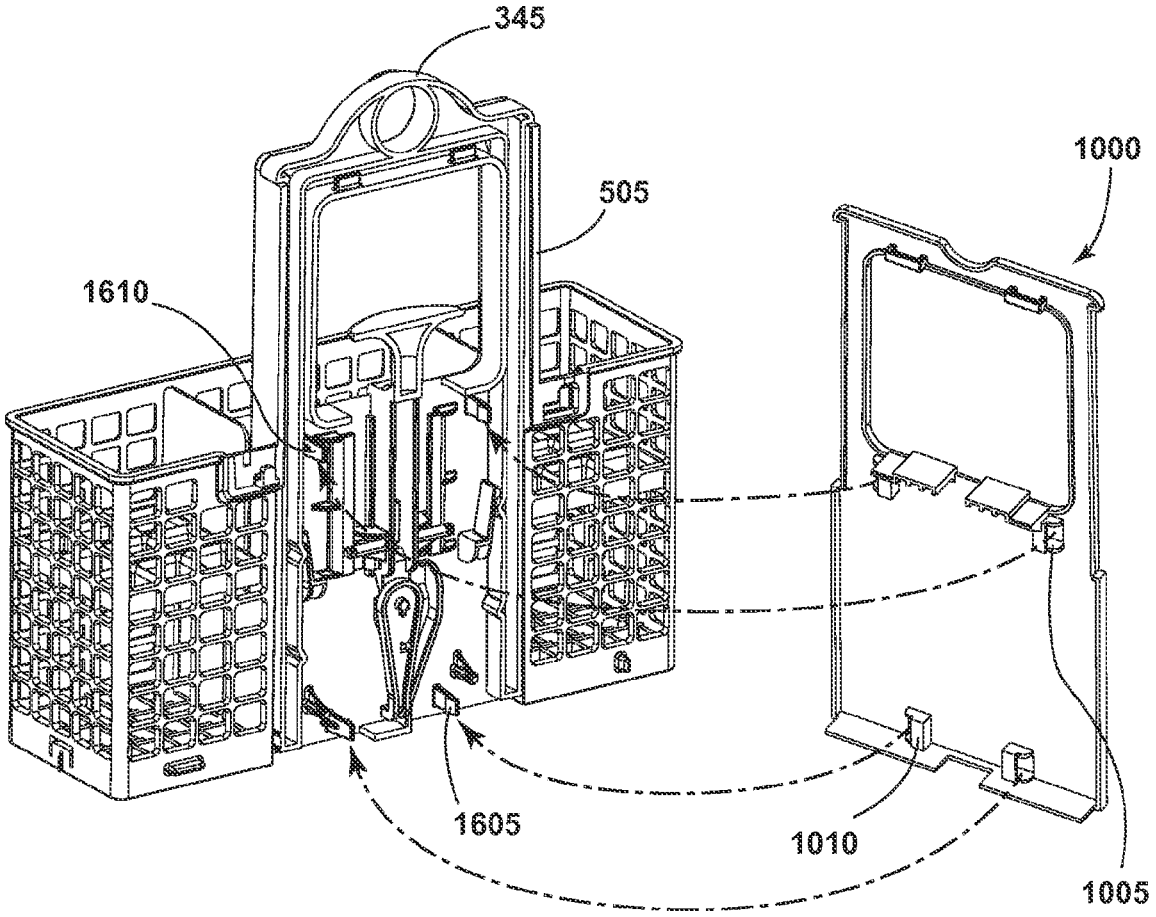

As shown in the rear isometric perspective view of FIG. 16, the back 1000 is snapped and/or otherwise affixed to the backside of the handle 505 thereby reducing the amount of liquids and/or food particles that can get into the handle assembly 340. As shown, the back 1000 is affixed to the handle 505 by engaging the features 1005 and 1010 of the back 1000 with the features 1605 and 1610 defined in the handle 505.

FIG. 17 is a front isometric perspective view of the example silverware basket 300 in a state that enables the easy and/or bulk loading of silverware into the silverware basket 300. FIG. 18 is a cross-sectional view taken along line XVIII-XVIII of FIG. 17. As shown, a person has used the portion 335 of the top member 325 to position the top member 325 in a lowered position within the basket 310. In this lowered position, a person can drop and/or place multiple pieces and/or a handful of silverware into the basket 310. Additionally and/or alternatively, silverware may be placed into the basket 310 piece-by-piece. The portion of the basket 310 above the lowered top member 325 reduces and/or prevents the dropped and/or placed handful of silverware from falling and/or spilling out of the basket 310. The stems of the silverware will naturally sort themselves into the openings 605 in the top member 325. In this manner, the person does not need to place the silverware piece-by-piece into the openings 605.

Figure 19:
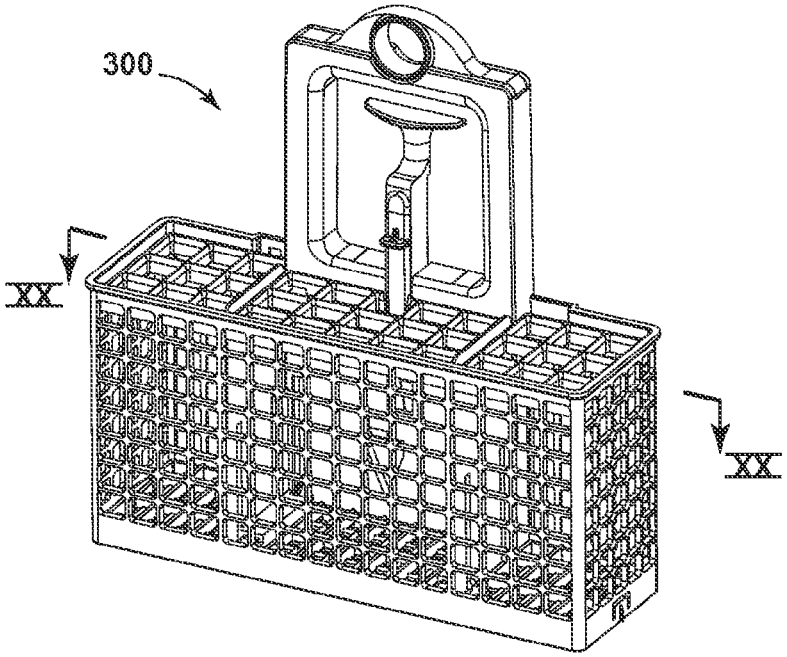
FIGS. 19 and 20 illustrate the example silverware basket of FIG. 3 in a state that facilitates the washing of silverware.
Figure 20:
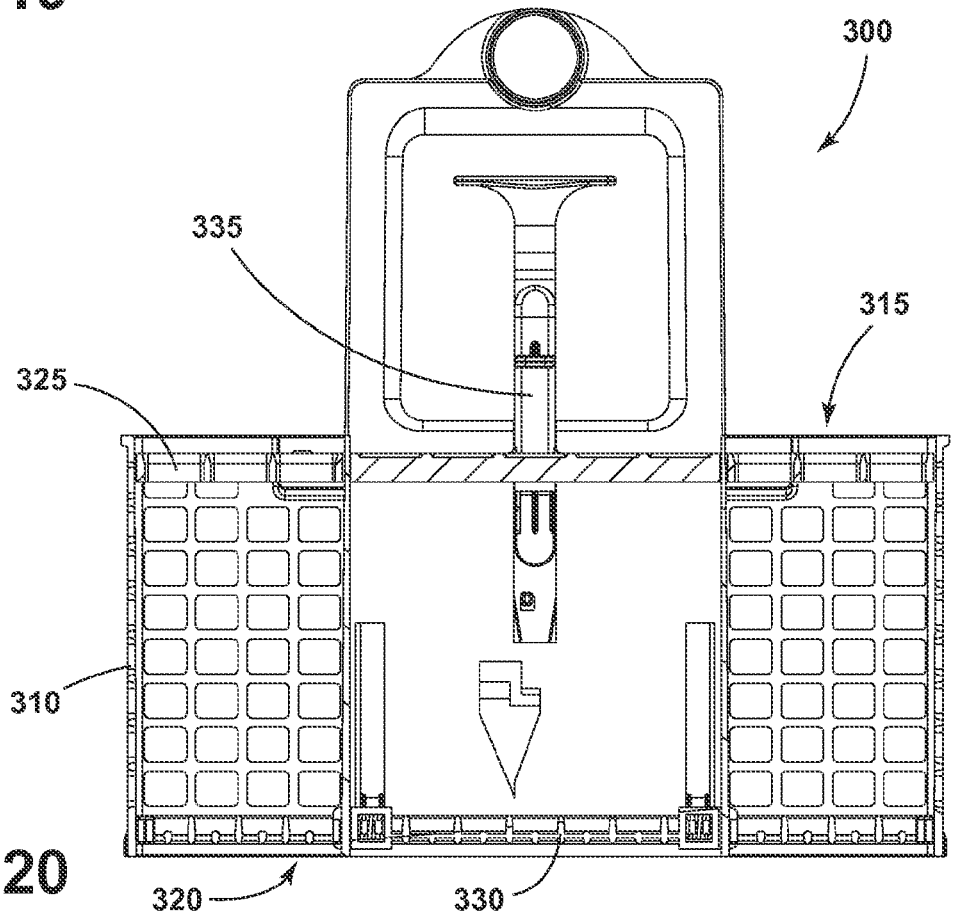

FIG. 19 is a front isometric perspective view of the example silverware basket 300 in a state for treating silverware present in the silverware basket 300. FIG. 20 is a cross-sectional view taken along line XX-XX of FIG. 19. As shown, a person has used the portion 335 of the top member 325 to position the top member 325 near the top opening 315. As the top member 325 is moved from the lowered position of FIGS. 17 and 18 to the upper position of FIGS. 19 and 20, the vertical orientation and/or separation of silverware placed in the basket 310 increases.

FIG. 21 is a front isometric perspective view of the example silverware basket 300 in a state for treating silverware present in the silverware basket 300. FIG. 22 is a cross-sectional view taken along line XXII-XXII of FIG. 21. As shown, a person has moved the handle 345 of the handle assembly 340 upward to move the bottom member 330 upward within the basket 310. As the bottom member 330 is moved upward from the lowered position of FIGS. 19 and 20, silverware present in the basket 310 is moved upward at least partially out of the top opening 315 of silverware basket 300. Because the silverware projects at least partially out of the top member 325, a person can easily unload the silverware by grasping stems of the silverware while avoiding inadvertent touching of clean feeding areas. The silverware may be unloaded piece-by-piece and/or multiple pieces at a time.

FIGS. 23A-H illustrate an example operation of the lever 800 as it interacts with the example feature 510. Starting with FIG. 23A, the top member 325 is in the lowered position of FIGS. 17 and 18. As shown, the lever 800 is in a lowered position relative to the feature 510.

Figure 23A:
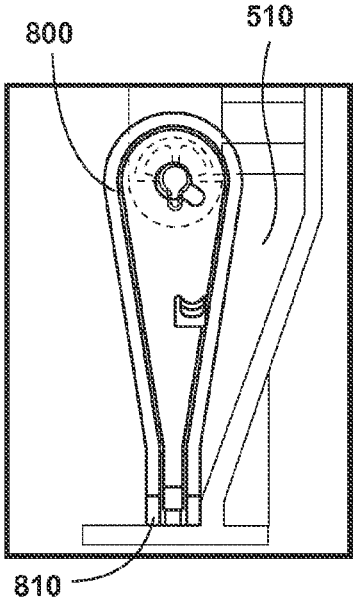
FIGS. 23A-H illustrate example operations of the example silverware basket of FIG. 3.
Figure 23B:
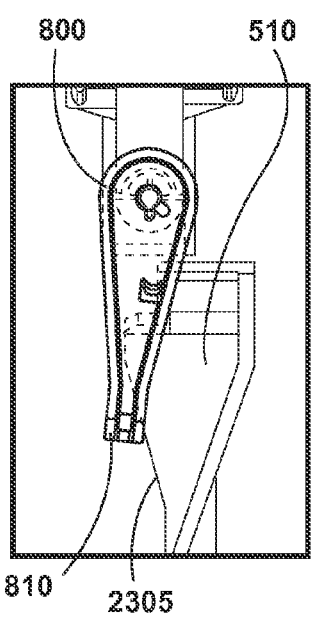
Figure 23C:
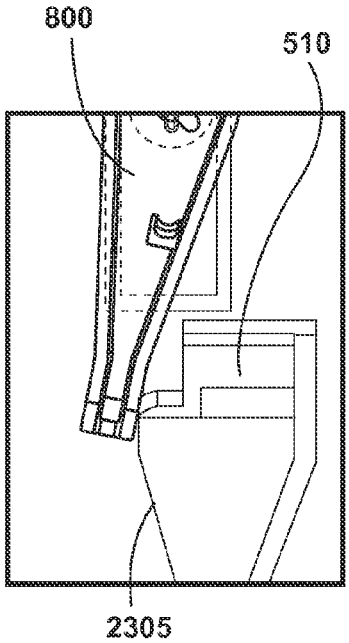

As a person moves the top member 325 upward, the protrusion 810 moves upward along an edge 2305 of the feature 510, as shown in FIGS. 23B and 23C. While not shown in FIGS. 23A-H, the spring 1210 (see FIG. 12) applies a rightward force (in the orientation of FIGS. 23A-H) to the lever 800 that keeps the protrusion 810 in contact with the edge 2305. The spring 1210 also biases the lever 800 against the backside of the handle 505. That is, against a plane perpendicular to FIGS. 23A-H. This biasing force keeps the protrusion 810 in contact with a surface formed by the edge 2315 (see FIG. 23E).

Figure 23D:
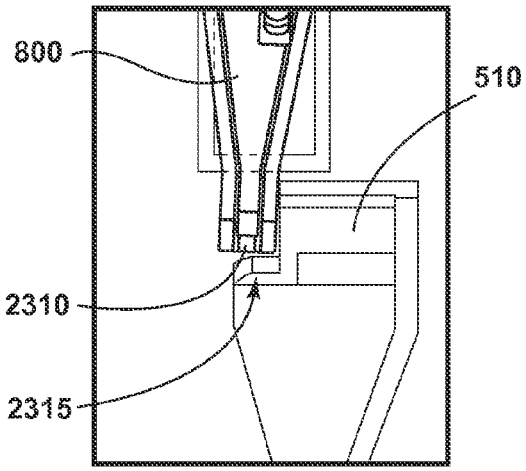
Figure 23E:
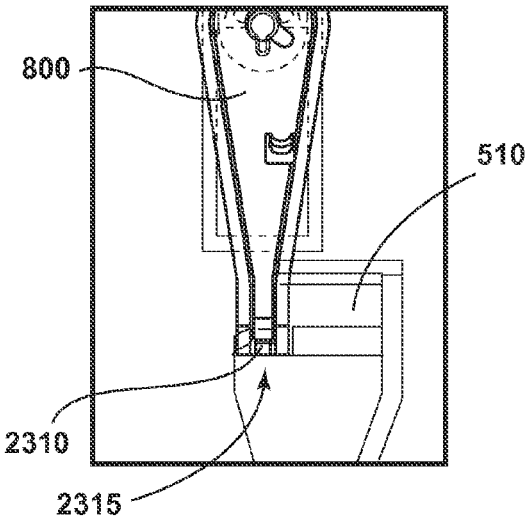

As shown in FIGS. 23D and 23E, as the top member 325 continues to be moved upward, the bottom 2310 of the lever 800 engages a notch 2315 defined in the feature 510, thus retaining and/or holding the lever 800 in an upward position thereby retaining and/or holding the top member 325 at a position near the top opening 315 (see FIGS. 19 and 20).

Figure 23F:
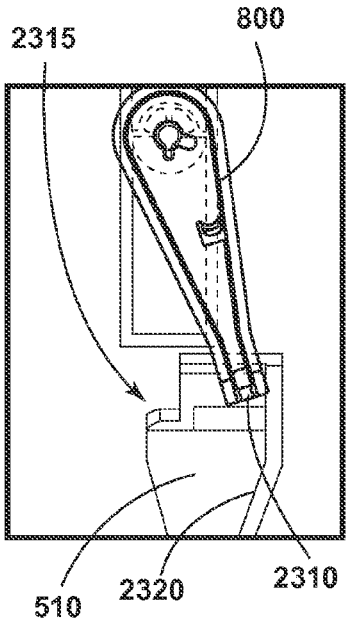

As shown in FIG. 23F, when the top member 325 is lifted upward beyond the position near the top opening 315, the bottom 2310 of the lever 800 disengages from the notch 2315 and moves rightward (in the orientation of FIGS. 23A-H) into contact with a second edge 2320 of the feature 510.

Figure 23G:
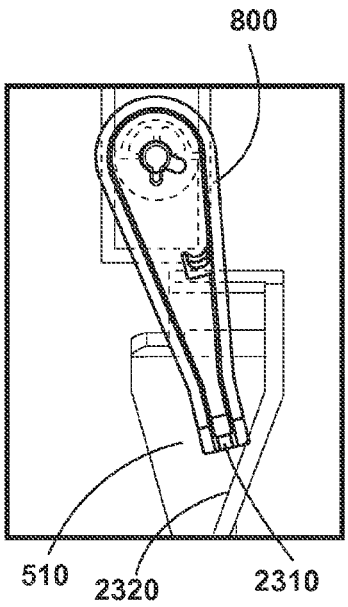
Figure 23H:
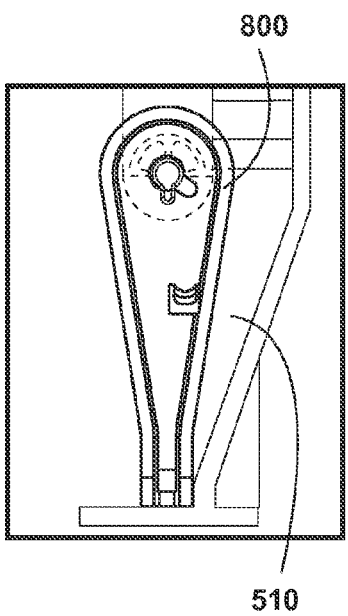
Figure 24:
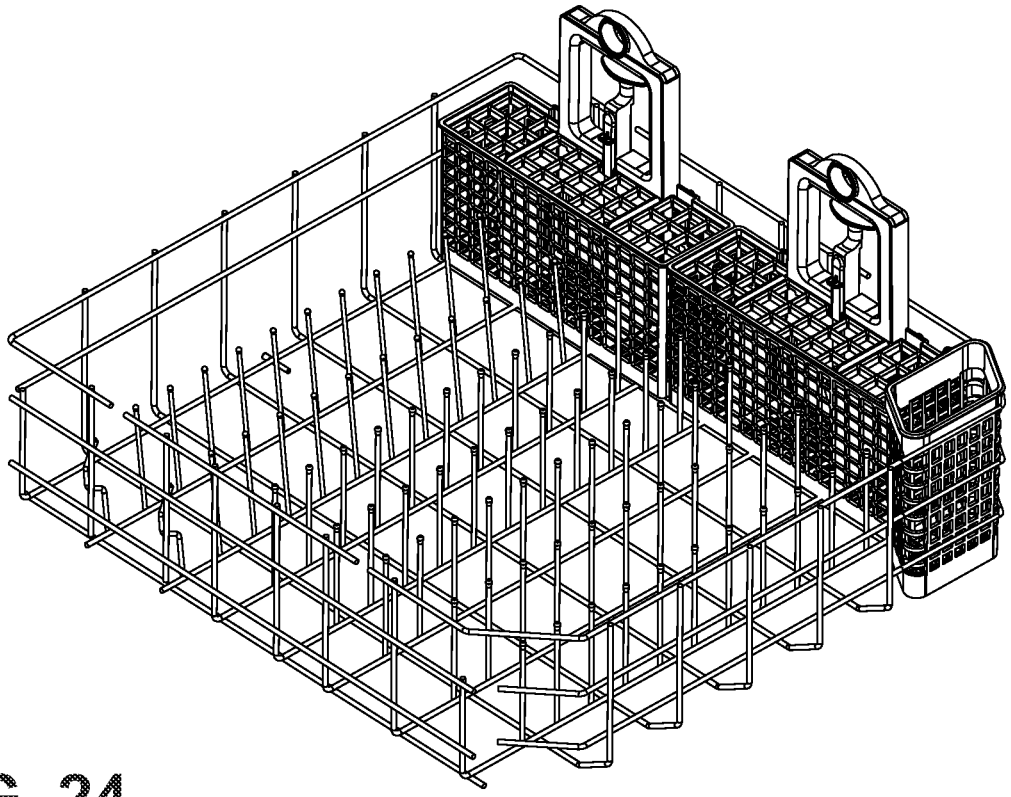
FIGS. 24-27 illustrate example dishwasher racks in which the example silverware baskets of FIGS. 3 and 4 may be positioned.
Figure 25:
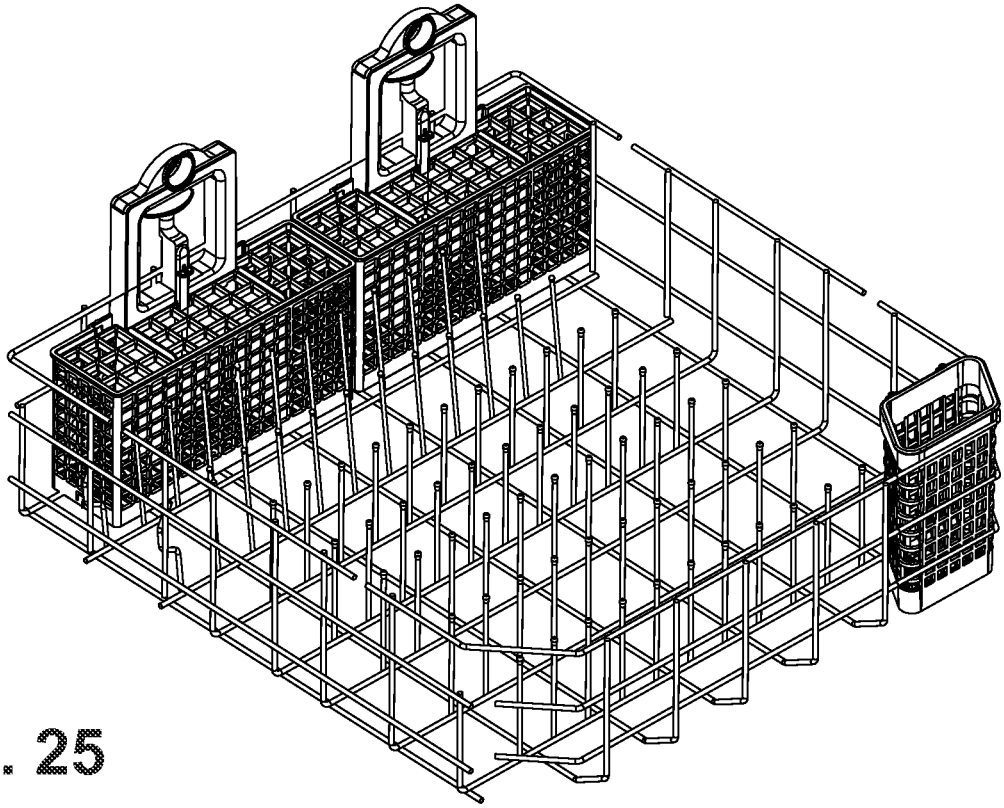
Figure 26:
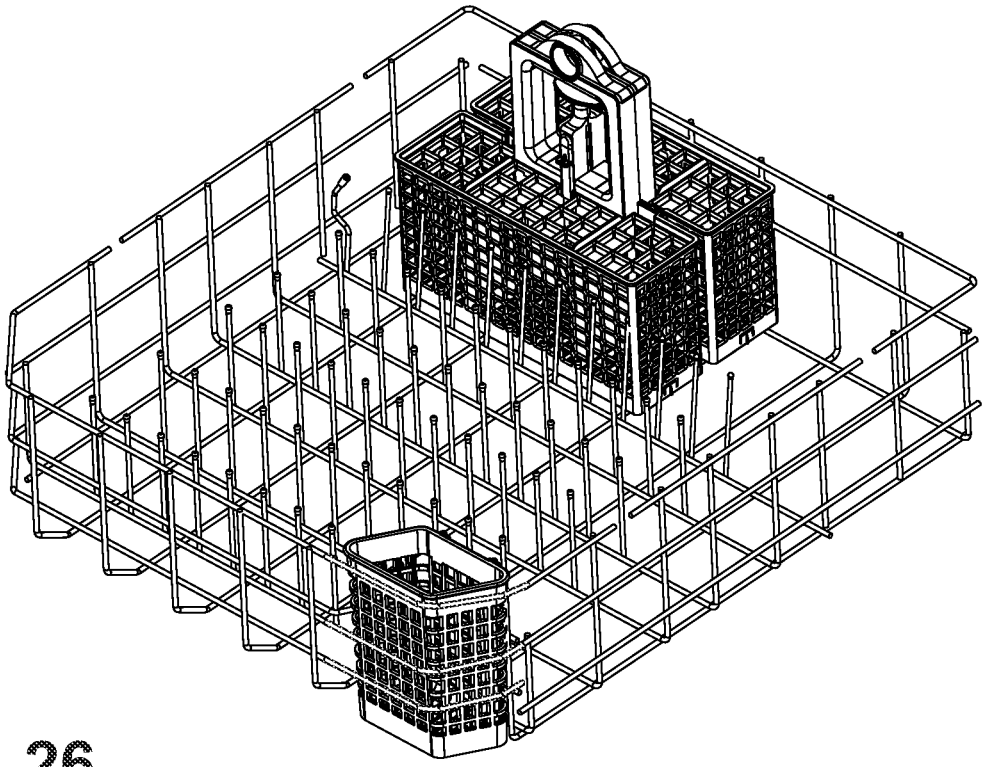
Figure 27:
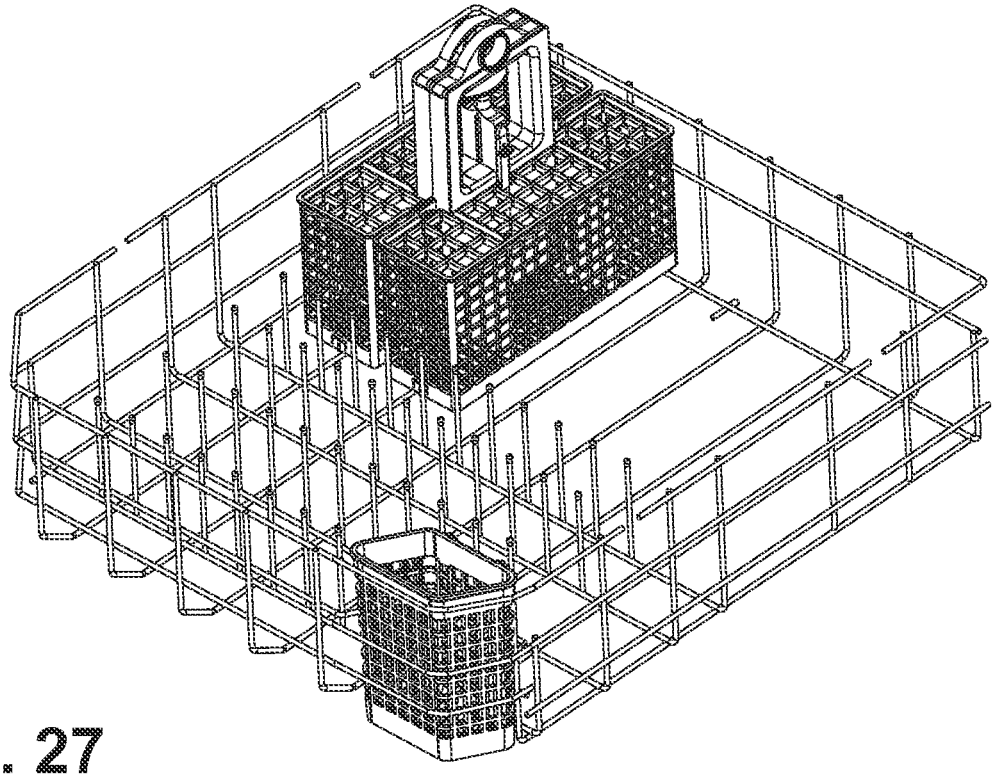

As shown in FIGS. 23G and 23H, the spring 1220 exerts a downward force (in the orientation of FIGS. 23A-H) that moves the bottom 2310 of the lever 800 downward along the edge 2320 to the lowered position of FIGS. 23H and 23A. Additionally or alternatively, a person may move the top member 325 and, thus, move the lever 800 downward using the portion 335.

FIGS. 24-27 illustrate example dish racks in which the example silverware baskets disclosed herein may be placed. As shown, different configurations and/or locations of silverware baskets may be used in different dish racks. Additionally or alternatively, different numbers of silverware baskets may be used.

Although certain examples have been described herein, the scope of coverage of this patent is not limited thereto. On the contrary, this patent covers all methods, apparatus and articles of manufacture fairly falling within the scope of the claims of this patent.

What is claimed is:

1. A silverware basket for use in a dishwasher, the silverware basket comprising:

four side walls defining a basket having a top opening and a bottom opening;

a moveable first member dimensioned to fit within the bottom opening and selectively moveable vertically between a first position near the bottom opening and a second position between the top opening and the bottom opening;

a moveable second member dimensioned to fit within the top opening of the basket and selectively movable vertically between a third position and a fourth position where the fourth position is below the third position; and a movable third member comprising a handle portion extending above the top opening and a leg portion operationally connected to the first member;

wherein moving the third member moves the first member between the first position and the second position.

2. The silverware basket of claim 1, wherein the silverware basket is configured to enable a person to selectively:

position the first member at the second position for loading of items into the silverware basket;

position the first member at the first position for a treating cycle of operation;

position the second member at the fourth position for the treating cycle of operation; and position the second member at the third position for unloading of the items from the silverware basket.

3. The silverware basket of claim 1, wherein movement of the first member from the first position to the second position moves items in the silverware basket at least partially out of the silverware basket.

4. The silverware basket of claim 1, wherein movement of the first member from the second position to the first position increases a vertical orientation and/or a separation of items in the silverware basket.

5. The silverware basket of claim 1, wherein movable second member further comprises a graspable element for repositioning the second member between the third position and the fourth position.

6. The silverware basket of claim 5, further comprising:

a spring biasing the second member towards the fourth position; and a releasable latch to hold the second member in the third position.

7. The silverware basket of claim 6, wherein releasing the latch allows the second member to move towards the fourth position.

8. The silverware basket of claim 1, further comprising:

a spring biasing the second member towards the fourth position; and a releasable latch to hold the second member in the third position.

9. A silverware basket for use in a dishwasher, the silverware basket comprising:

four side walls defining a basket having a top opening and a bottom opening;

a moveable bottom member dimensioned to fit within the bottom opening and selectively moveable between a first position near the bottom opening and a second position between the top opening and the bottom opening; and a moveable bottom lift selectively movable between a third position and a fourth position, the bottom lift comprising:

a handle portion extending above the top opening; and a leg portion operationally connected to the bottom member;

wherein moving the bottom lift between the third position and the fourth position moves the bottom member between the first position and the second position.

10. The silverware basket of claim 9, wherein the bottom lift has an element that enables a person to selectively move the bottom lift between the third and fourth positions.

11. The silverware basket of claim 10, wherein the element comprises a graspable element.

12. The silverware basket of claim 9, wherein the silverware basket is configured to enable a person to position the bottom member at the second position for loading of items into the silverware basket, and at the first position for a treating cycle of operation.

13. The silverware basket of claim 12, wherein the silverware basket is configured so that movement of the bottom member from the second position to the first position increases a vertical orientation and/or a separation of the items.

14. The silverware basket of claim 9, wherein the silverware basket is configured so that movement of the bottom member from the first position to the second position moves silverware items at least partially out of the silverware basket.

15. The silverware basket of claim 9, further comprising:

a movable top member dimensioned to fit within the top opening and selectively movable between a fifth position and a sixth position;

a spring biasing the top member towards the fifth position; and a releasable latch to hold the top member in the sixth position.

16. The silverware basket of claim 15, wherein the top member moves towards the fifth position when the latch is released.

17. A method of using a silverware basket, the method comprising:

moving a top member of a silverware basket to a position lower than a top of the basket;

placing silverware in the basket; and moving the top member to a position at the top of the basket to separate a first piece of silverware from a second piece of silverware;

wherein moving the top member to the position lower than the top of the basket comprises moving the top member upward before moving the top member downward.

18. The method of claim 17, further comprising moving a bottom member of the basket upward to move the silverware at least partially through the top member.

* * * * *